US006799841B2

(12) United States Patent
Iri et al.

(10) Patent No.: US 6,799,841 B2
(45) Date of Patent: Oct. 5, 2004

(54) INK JET RECORDING HEAD, INK JET RECORDING APPARATUS USING SUCH INK JET RECORDING HEAD, AND METHOD FOR MANUFACTURING INK JET RECORDING HEAD

(75) Inventors: Junichiro Iri, Kanagawa (JP); Toshio Kashino, Kanagawa (JP); Hiroyuki Kigami, Kanagawa (JP); Hiroyuki Maeda, Kanagawa (JP); Akira Goto, Kanagawa (JP); Hiroki Tajima, Kanagawa (JP); Yasushi Iijima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 77 days.

(21) Appl. No.: 10/237,775

(22) Filed: Sep. 10, 2002

(65) Prior Publication Data

US 2003/0067517 A1 Apr. 10, 2003

(30) Foreign Application Priority Data

Sep. 14, 2001 (JP) ..... 2001-280563

(51) Int. Cl.[7] ..... B41J 2/175
(52) U.S. Cl. ..... 347/85; 347/87
(58) Field of Search ..... 347/20, 47, 65, 347/85, 86, 87

(56) References Cited

U.S. PATENT DOCUMENTS 5,389,957 A 2/1995 Kimura et al. ..... 347/20
5,563,641 A * 10/1996 Plesinger ..... 347/47
5,874,971 A * 2/1999 Nishioka et al. ..... 347/20
6,079,810 A * 6/2000 Davis ..... 347/47
6,109,734 A 8/2000 Kashino et al. ..... 347/65
6,220,688 B1 4/2001 Ishimatsu et al. ..... 347/20
6,254,215 B1 7/2001 Hiroki et al. ..... 347/20

* cited by examiner

*Primary Examiner*—Anh T. N. Vo
(74) *Attorney, Agent, or Firm*—Fitzpatrick, Cella, Harper & Scinto

(57) ABSTRACT

An ink jet recording head comprises an ink tank, a nozzle for discharging ink, a liquid chamber for retaining a specific amount of ink supplied from the ink tank through a filter, while supplying ink to the nozzle, and a covering member to be bonded to the liquid chamber, and on the circumference of the liquid chamber, a groove is formed to enable bonding agent to be coated therefor, and on the circumference of the covering member, an extrusion is formed to be fitted into the groove. For this ink jet recording head, gas releasing means is provided for releasing gas remaining in the bonding agent to the outside of the groove when the covering member is bonded to the liquid chamber by fitting the extrusion into the groove after the bonding agent is coated in the groove. With the structure thus arranged, it is possible to prevent leakage form occurring between liquid chambers, because voids are not formed by gas remaining in the bonding agent, which may connect liquid chambers adjacent to each other, and each of the liquid chambers is airtightly closed in the ink jet recording head for a better performance thereof.

21 Claims, 16 Drawing Sheets

FIG. 10C1
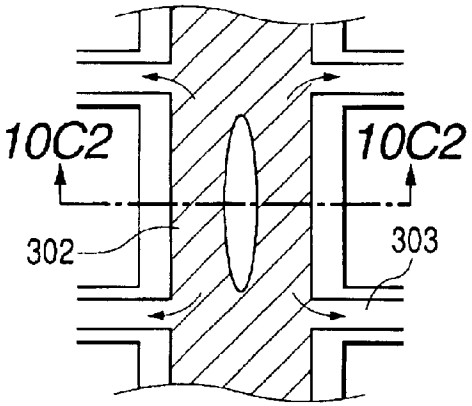
FIG. 10C2
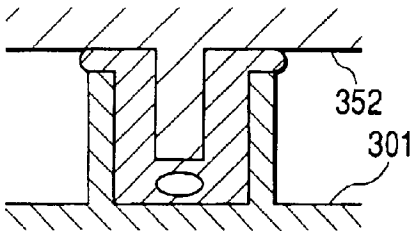
FIG. 10B1
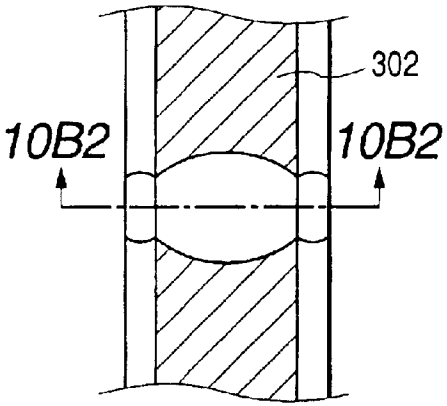
FIG. 10B2
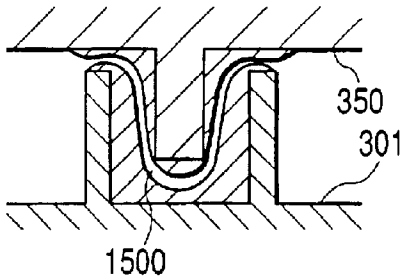
FIG. 10A1
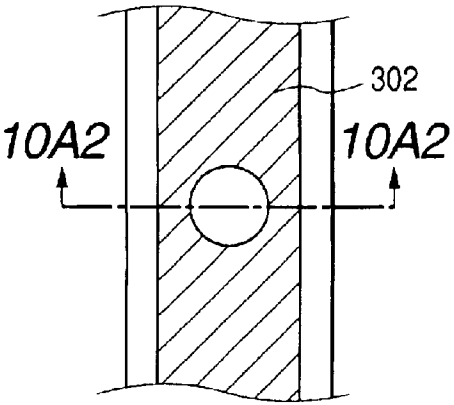
FIG. 10A2
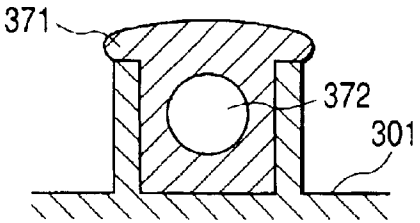

INK JET RECORDING HEAD, INK JET RECORDING APPARATUS USING SUCH INK JET RECORDING HEAD, AND METHOD FOR MANUFACTURING INK JET RECORDING HEAD

BACKGROUND OF THE INVENTION

1. Field of the Invention

The present invention relates to an ink jet recording head, an ink jet recording apparatus using such ink jet recording head, and a method for manufacturing ink jet recording head.

2. Related Background Art

Of recording methods for a printer or the like, the ink jet recording method for forming characters, images, and the like on a recording medium by discharging ink for discharge ports (nozzles) has been widely adopted recent years, because it is non-impact recording method having a lesser amount of noises, while it can perform recording operation in high density at high speed.

A general ink jet recording apparatus is provided with an ink jet recording head; means for driving a carriage that mounts it; means for conveying a recording medium, and means for controlling them. The ink jet recording apparatus thus structured, that performs recording operation with the carriage, which is made to travel, is called serial type. On the other hand, the one that performs recording operation only by conveying a recording medium without the traveling of an ink jet head, is called line type. For the ink jet recording apparatus of line type, many numbers of nozzles are arranged in line all over the widthwise direction of a recording medium.

The ink jet recording head is provided with energy generating means for generating the discharge energy, which is given to ink in the nozzle in order to discharge ink droplets from the nozzle. As means for generating energy, there is the one that uses electromechanical converting element, such as piezoelectric element, the one that uses electrothermal converting element, such as heat generating resistive member, or the one that uses electromagnetic wave mechanical converting element or electromagnetic wave heat converting element, which converts electric waves of radio wave, laser, or the like into mechanical vibrations or heat, among some others. Of these methods, the type that discharges ink droplets by the utilization of thermal energy makes it possible to perform recording in high resolution, because nozzles can be arranged in high density. Particularly, the ink jet recording head that uses electrothermal converting element as the energy-generating element is easier to make it smaller than the head using electromechanical converting element. Further, such head has an advantage that it can fully utilize the IC technologies and micro machining techniques, the advancement and reliability of which have made a remarkable progress in the field of semiconductor manufacture in recent years, for easier assembling in high density at lower costs of manufacture.

As the ink supply method for an ink jet recording head, there is the one, which is of the so-called head-tank integrated type where the ink tank containing ink and the ink jet recording head are made one body; the one, which is of the so-called tube supply type where an ink tank and an ink jet recording head are connected by use of tube, or the one, which is of the so-called pit-in type where an ink tank and an ink jet recording head are provided separately, and the ink jet recording head moves to the position of the ink tank as required to connect them, and ink is supplied during such operation.

If the capacity of an ink tank is made larger in order to make the frequency of ink tank replacements smaller, the weight of the ink tank should increase. Therefore, in consideration of the increased weight given to the carriage of an ink jet recording apparatus of serial type then, it is not preferable to adopt the head-tank integrated one. Consequently, the ink jet recording apparatus of serial type that uses an ink tank of larger capacity adopts the tube-supply type or pit-in type more often. Of such types, the tube supply type, which makes it possible to perform a continuous recording for a long time, is adopted more often, because the pit-in type needs to suspend recording operation during the period of ink supply.

Hereunder, with reference to FIG. 16, the description will be made of the ink supply system of an ink jet recording apparatus of tube supply type.

The ink supply system shown in FIG. 16 is provided with a main tank 1204 containing ink 1209 therein; a supply unit 1205 detachably installed in the main tank 1204; and a recording head 1201 connected with the supply unit 1205 through a supply tube 1206.

The supply unit 1205 has an ink chamber 1205*c* therein. The ink chamber 1205*c* is open to the air outside by way of an atmosphere communication port 1205*g*, while it is connected with the supply tube 1206 at the bottom thereof. Also, for the supply unit 1205, there are fixed the ink supply needle 1205*a* and the air induction needle 1205*b*, the lower ends of which are positioned in the ink chamber 1205*c*, and the upper end of which are extruded from the upper face of the supply unit 1205, respectively.

The lower end of the ink supply needle 1205*a* is positioned lower than the lower end of the air induction needle 1205*b*.

The main tank 1204 has two connector portions formed by rubber plug or the like at the bottom thereof in order to close the inside of the main tank 1204 airtightly. Thus, the main tank is structured to be airtight individually. When the main tank 1204 is installed on the supply unit 1205, the ink supply needle 1205*a* and the air induction needle 1205*b* penetrate the connector portions, respectively, so as to enter the inside the main tank 1204. Now that the positions of the lower end of the ink supply needle 1205*a* and the air induction needle 1205*b* are defined as described above, ink in the main tank 1204 is supplied to the ink chamber 1205*c* through the ink supply needle 1205*a*, and the air outside is inducted into the main tank 1204 through the air induction needle 1205*b* so as to compensate for the reduction of pressure in the main tank 1204. When ink is supplied into the ink chamber 1205*c* up to the position where the lower end of the air induction needle 1205*a* is immersed in ink, the ink supply from the main tank 1204 to the ink chamber 1205*c* is suspended.

The recording head 1201 is provided with a sub-tank portion 1201*b* in which a designated amount of ink is retained; an ink discharge portion 1201*g* where a plurality of nozzles is arranged for discharging ink; and a flow path that connects the sub-tank portion 1201*b* and ink discharge portion 1201*g*. For the ink discharge portion 1201*g*, nozzles are arranged with the opening surface thereof being placed downward, thus discharging ink downward. In each nozzle of the ink discharge portion 1201*g*, the aforesaid energy generating means is arranged. The sub-tank portion 1201*b* is positioned above the ink discharge portion 1201*g*, and the supply tube 1206 is connected with the sub-tank portion 1201*b*. Between the sub-tank portion 1201*b* and the flow path 1201*f*, a filter 1201*c* is installed with a fine mesh structure for preventing the nozzle from being clogged by minute foreign substances in ink that may otherwise enter the ink discharge portion 1201*g*.

The area of the filter 1201*c* is defined to be a value to make the pressure loss by ink to be less than the allowable value. The higher the pressure loss of the filter 1201*c*, the finer is the mesh of the filter 1201*c*, and also, the more is the flow rate of ink passing the filter 1201*c*. On the contrary, the pressure loss is inversely proportional to the area of the filter 1201*c*. There is a tendency that the pressure loss becomes higher in a micro-dot recording head having many nozzles at higher-speed recording in recent years. Therefore, the area of the filter 1201*c* is made as large as possible in order to suppress the increase of pressure loss.

The nozzle is opened to the atmosphere, and also, the opening surface of the nozzle is placed downward. Therefore, in order to prevent ink leakage from the nozzle, it is necessary to keep the inside of the recording head 1201 to be negatively pressurized. On the other hand, if the negative pressure is too great, the air enters the nozzle to disable the ink discharge from the nozzle eventually. Here, therefore, in order to enable the inside of the recording head 1201 to be negatively pressurized appropriately, the recording head 1201 is arranged so that the position of the nozzle-opening surface becomes higher by a height H than the liquid surface of ink in the ink chamber 1205*c*, thus keeping the inner condition of the recording head 1201 at negative pressure corresponding to the portion of the water head difference by the height H. In this manner, the nozzle is kept in a state of being filled with ink with the formation of meniscus on the opening surface.

Ink is discharged from the nozzle by pushing out ink in the nozzle by driving energy generating means. After ink is discharged, ink is filled in the nozzle by means of capillary force. During a recording operation, ink discharges from the nozzle and ink filling to the nozzle are repeated, and ink is suck from the ink chamber 1205*c* from time to time by way of the supply tube 1206.

When ink is sucked from the ink chamber 1205*c* to the recording head 1201, the position of the liquid surface of ink in the ink chamber 1205*c* is made lower than the lower end of the air induction needle 1205*b*. Then, the air outside is induced into the main tank 1204 through the air induction needle 1205*b*. Along with this, ink in the main tank 1204 is supplied to the ink chamber 1205*c*. Then, the lower end of the air induction needle 1205*b* is again immersed in ink in the ink chamber 1205*c*. While this action is repeated, ink in the main tank 1204 is supplied to the recording head 1201 along with the ink discharge from the recording head 1201.

Now, however, in the sub-tank portion 1201*b* of the recording head 1201, the air that enters after permeating resin material of the supply tube 1206 or the like, and the air dissolved to reside in ink are gradually accumulated. In order to exhaust excessive air accumulated in the sub-tank portion 1201*b*, the exhaust tube 1211, which is connected with an exhaust pump 1211*a*, is connected to the sub-tank portion 1201*b*. Here, a valve 1211*b* is provided for the exhaust tube 1211 for keeping the inside of the recording head 1201 in an appropriate negative pressure as described above. The valve 1211*b* is open only at the time of air-exhaust operation so as not to allow the inside of the recording head 1201 to present the atmospheric pressure.

In this respect, if overly viscous ink or the like is clogged in the ink discharge portion 1201*g* or bubbles are generated in the ink discharge portion 1201*g* by the accumulation of dissolved air in ink, these should be removed, and for that matter, a recovery unit 1207 is generally provided for an ink jet recording apparatus. The recovery unit 1207 is provided with a cap 1207*a* to cap the nozzle-opening surface of the recording head 1201, and a suction pump 1207*c* connected to this cap 1207*a*. Then, the suction pump 1207*c* is driven in a state where the nozzle-opening surface is capped by the cap 1207*a* to forcefully suck ink from the inside the recording head 1201 for the removal of the overly viscous ink or the like and excessive bubbles from the ink discharge portion 1201*g*.

When the operation of recovery suction is performed, overly viscous ink or the like and excessive bubbles can be removed more effectively if the ink flow is faster. Therefore, to make the ink flow faster in the flow path 1201*f*, the sectional area of the flow path 1201*f* is made smaller. On the other hand, the sectional area of the filter 1201*c* is made as large as possible. As a result, the sectional area of the flow path 1201*f* is configured to be narrower below the filter 1201*c*.

As has been given above, the description of the conventional ink supply system is made exemplifying the tube supply method. However, for the head integrated method or the pit-in method, the structure of the recording head on the downstream side of the filter is fundamentally the same as that of the tube supply method, although the structure of the supply passage from the ink tank to the recording head is only different from each other.

The recording head described above forms an airtight space with a flow path cover, which is bonded to the liquid chamber portion of the sub-tank unit. However, if such airtightly closed condition of each chamber is not perfect, leakage may take place. For example, some bubbling is embraced in the bonding portion at the time of coating bonding agent, and such bubbling is inclusively contained when the tank unit and the flow path cover are bonded, thus creating a hollow portion that connects liquid chambers. Then, leakage takes place through such hollow portion.

If the tank unit and flow path cover are bonded after coating bonding agent in a state where bubbling is inclusively contained as shown in FIG. 17A, a hollow 1500 that connects liquid chambers A and B as shown in FIG. 17B. As a result, leakage takes place between the liquid chambers A and B, and due to such leakage, ink in each of the liquid chambers is mixed. Thus, there is a possibility that color mixture occurs.

Also, when hardening cure is given to bonding agent, for example, vapor generated from the tank unit and the flow path cover is developed as the temperature rises. Then, a hollow that connects the liquid chambers is created, and leakage takes place through the hollow thus created. Here, in FIG. 17A, a reference numeral 1371 designates bonding agent, and 1372, mixed bubble.

Now, when bonding agent is cured after bonding the tank unit and the flow path cover together as shown in FIG. 18A, vapor is generated from material of the members constituting the tank unit and the flow path cover as shown in FIG. 18B. With the development of vapor mixed in bonding agent, the hollow that connects liquid chambers is created as shown in FIG. 18C, and leakage takes place between the liquid chambers A and B. Then, as in the case described above, ink is mixed with each other due to such leakage, and there is a possibility that color mixture occurs. Here, in FIG. 18B, a reference numeral 1373 designates bubbles.

SUMMARY OF THE INVENTION

The present invention is designed with a view to solving the problems discussed above. It is an object of the invention to materialize the provision of an ink jet recording head capable of preventing bubbles from being inclusively retained in bonding agent when the covering member is bonded to the liquid chamber portion of the recording head, thus eliminating the drawback that may be caused by leakage between liquid chambers, as well as to materialize the provision of an ink jet recording apparatus using such recording head. It is also an object of the invention to provide a method for manufacturing such ink jet recording head.

In order to achieve the object described above, the ink jet recording head of the present invention comprises an ink tank; a nozzle for discharging ink; a liquid chamber for retaining a specific amount of ink supplied from the ink tank through a filter, while supplying ink to the nozzle; and a covering member to be bonded to the liquid chamber, and on the circumference of the liquid chamber a groove is formed to enable bonding agent to be coated therefor, and on the circumference of the covering member, an extrusion is formed to be fitted into the groove. For this ink jet recording head, gas releasing means is provided for releasing gas remaining in the bonding agent to the outside of the groove when the covering member is bonded to the liquid chamber by fitting the extrusion into the groove after the bonding agent is coated in the groove.

In accordance with the ink jet recording head of the present invention, gas remaining in bonding agent is released to the outside of the groove. As a result, no void is formed by gas remaining in the bonding agent, which may otherwise connect liquid chambers adjacent to each other, thus airtightly close each of the liquid chambers, hence making it possible to prevent leakage from occurring between liquid chambers.

Further, the structure may be arranged to provide the gas releasing means on the covering member side. In this case, the gas releasing means may be formed as a hole that penetrates the surface of the covering member to the backside thereof along the extrusion of the covering member. With the structure thus arranged, gas remaining in the bonding agent is released outside the groove through the hole of the covering member when the covering member is bonded to the liquid chamber by fitting the extrusion into the groove.

Or it may be possible to structure the gas releasing means to be on the liquid chamber side. In this case, the gas releasing means is a passage communicating the space in the groove and the space in the liquid chamber. With this structure, gas remaining in the bonding agent is released from the groove to the liquid chamber through such passage when the covering member is bonded to the liquid chamber by fitting the extrusion into the groove.

Also, the structure may be arranged to provide a set of the ink tank, nozzle, and liquid chamber in plural numbers individually.

Further, the structure may be arranged to configure each of the liquid chambers radially so as to expand from the plural nozzles toward the ink tanks to make the width formed by the plural nozzles smaller than the width formed by the plural ink tanks.

Also, the groove may be structured so that the width thereof expands gradually from the bottom face to the entrance thereof, and the sectional shape is formed with a smoothly curved line connecting the bottom face and the side face. In this manner, the width of the groove is made larger form the bottom face thereof toward the entrance gradually, thus making it easier to coat bonding agent, and also, the bonding agent is applied deep into the bottom portion reliably, hence eliminating such drawback that the bonding agent has bubbles inclusively. Also, bubbles tend to stay at the corners, but with the smoothly curved line formed for the groove to connect the bottom face and side face thereof, it becomes possible to prevent bubbles from staying at corner portions.

Further, the aforesaid extrusion has the sectional shape having rounded tip portion. As compared with the one having the square tip, it is in contact with bonding agent smoothly to press it gradually when it is pushed into the bonding agent in the groove. As a result, it becomes possible to prevent more reliably bubbles from being generated in the bonding agent or to allow them to be contained in it inclusively.

Also, the structure may be arranged to enable the height of the extrusion of the covering member and the amount of bending of the covering member as a whole to be in relations of the height of extrusion>the amount of bending of covering member as a whole. With the structure thus arranged, even if the central portion of the flow path cover is caused to float up by the amount of bending as a whole, the tip of the extrusion on the central portion of the flow path cover enters the groove. Therefore, it is made possible to prevent leakage or the like from being generated between liquid chambers themselves due to defective bonding or the like.

Also, the structure may be arranged so that the shape of the groove observed from the side having the covering member bonded is formed by a vertically directional component, a horizontally directional component, and a diagonally directional component intersecting at least either one of the vertically directional component and the horizontally direction component. In this way, even if there exists "play" between the groove and the extrusion, the groove formed by such three directional components suppresses such "play" as much as possible to make it possible to bond them in a better precision.

Further, the structure may be arranged so that the bonding agent coating (application) area of the portion having arbitrary four intersecting components or more is larger than the bonding agent coating area of the portion having arbitrary three components or less among those components of the groove. Since bubbles are easier to be generated on the intersecting portions in particular when bonding agent is coated. However, on the portion where the bonding agent coating area is made larger as described above, the coating amount of the bonding agent is larger than the other portions. Therefore, even if bubbles are slightly generated, the influence exerted by such bubbles becomes relatively small, and the possibility is smaller that voids are formed between liquid chambers by leakage or the like due to the existence of such bubbles.

Also, the ink jet recording apparatus of the present invention uses the ink jet recording head of the present invention as described above.

Also, the method of the present invention for manufacturing an ink jet recording head, which is provided with an ink tank, a nozzle for discharging ink, a liquid chamber for retaining a specific amount of ink supplied from the ink tank through a filter, and a covering member to be bonded to the liquid chamber, and on the circumference of the liquid chamber, a groove being formed for bonding agent to be coated therein, and on the circumference of the covering member, an extrusion being formed to be fitted into the groove, comprises the steps of coating the bonding agent in the groove; bonding the covering member to the liquid chamber by fitting the extrusion into the groove; and releasing gas remaining in the bonding agent to the outside of the groove.

In accordance with the aforesaid method of the present invention for manufacturing an ink jet recording head, gas remaining in the bonding agent is released outside the groove. Therefore, the voids that may connect the liquid chambers adjacent to each other are not formed by gas remaining in the bonding agent, hence airtightly closing each of the liquid chambers reliably. Then, it becomes possible to manufacture an ink jet recording apparatus capable of preventing leakage from being generated between liquid chambers.

Further, the structure may be arranged so that a hole is provided for the covering member penetrating the surface of the covering member to the backside thereof along the extrusion, and the aforesaid step of releasing gas remaining in the bonding agent to the outside of the groove comprises the step of releasing the gas to the outside of the groove through the hole.

Or the structure may be arranged so that a passage is provided for the liquid chamber communicating the space in the groove and the space in the liquid chamber, and the step of releasing gas remaining in the bonding agent to the outside of the groove comprises the step of releasing the gas to the outside of the groove through the passage.

Also, the step of coating the bonding agent in the groove is to continuously coating the bonding agent during the period from the start to the end of coating the bonding agent. With the structure thus arranged, it is made possible to suppress the mixture of bubbles in the bonding agent being coated.

Further, the structure may be arranged so that the traveling speed of the needle with respect to the groove is changed when coating the bonding agent on the straight portion of the groove and at the corner portion of the groove, while constantly keeping the coating amount of the bonding agent discharged from the needle per unit time. If coating is carried out at the same speed for all the portions of the groove, the coating amount of bonding agent becomes larger at the corner portions of the groove than the straight portions thereof. Therefore, the traveling speed of the needle increases at the corner portions and decreases on the straight portions. In this manner, it becomes possible to stabilize the coating amount, while implementing the prevention of bubble inclusion in bonding agent.

Or the structure may be arranged so that the discharge pressure of the bonding agent from the needle is changed when coating the bonding agent on the straight portion of the groove and at the corner portion of the grove, while constantly keeping the traveling speed of the needle for discharging bonding agent with respect to the groove. In this way, as in the structure described above, it becomes possible to stabilize the coating amount, while implementing the prevention of bubble inclusion in bonding agent.

Also, the structure may be arranged so that the method of manufacture further comprises a step of curing the bonding agent to be hardened after the step of releasing gas remaining in the bonding agent to the outside of the groove.

Further, the structure may be arranged so that the aforesaid curing step comprises a pre-curing step for hardening the bonding agent at a comparatively low temperature, and a regular curing step for hardening the bonding agent at a comparatively high temperature. The portions of the bonding agent, which are in contact with the groove and the flow path cover are half hardened through the pre-curing. Therefore, even if vapors are generated from the structural material of the groove and the flow path cover when the regular curing is carried out at high temperature, such vapors cannot penetrate the half-hardened bonding agent, hence making it possible to suppress the mixture of vapors in the bonding agent.

BRIEF DESCRIPTION OF THE DRAWINGS

FIGS. 10A1, 10A2, 10B1, 10B2, 10C1 and 10C2 are views that illustrate the states where the bubble, which is mixed in a groove portion, is released to the outside.

DETAILED DESCRIPTION OF THE PREFERRED EMBODIMENTS

Next, with reference to the accompanying drawings, the description will be made of the embodiments in accordance with the present invention.

Figure 1:
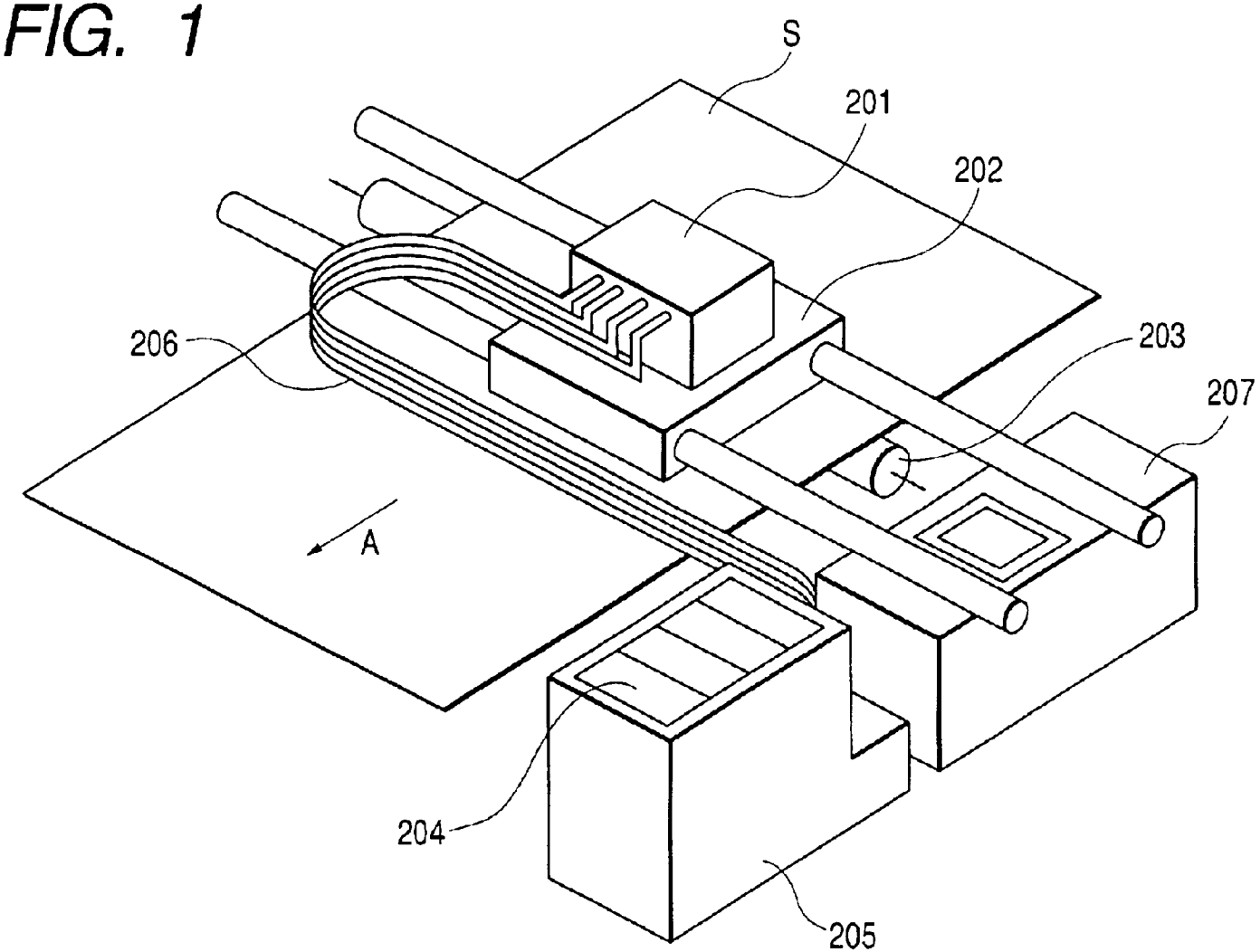
FIG. 1 is a perspective view that schematically shows the structure of an ink jet recording apparatus embodying the present invention.

FIG. 1 is a perspective view that schematically shows the structure of an ink jet recording apparatus embodying the present invention.

As shown in FIG. 1, the ink jet recording apparatus is a recording apparatus of serial type in which it is arranged to conduct the reciprocation of a recording head 201 (main scans), and conveyance of a recording sheet S, such as an ordinary recording sheet, a specially-treated paper, an OHP film, per designated pitch (sub-scans) repeatedly, and in synchronism herewith, the recording head 201 discharges ink selectively to the recording sheet S for the provision thereof to form characters, symbols, images, or the like thereon.

In FIG. 1, the recording head 201 is detachably mounted on a carriage 202 slidably supported by two guide rails, which reciprocates along the guide rails by use of driving means, such as a motor (not shown). The recording sheet S faces the ink discharge surface of the recording head 201 by means of a conveying roller 203, which is conveyed in the direction intersecting the traveling direction of the carriage 202 (in the direction indicated by an arrow A, that is, the direction orthogonal thereto, for example) while keeping a distance to the ink discharge surface constantly.

The recording head 201 is provided with plural nozzle arrays for discharging ink of different colors, respectively. Depending on the colors of ink to be discharged from the recording head 201, a plurality of individual main tanks 204 is detachably installed on an ink supply unit 205. The ink supply unit 205 and the recording head 201 are connected by use of plural ink supply tubes 206 corresponding to colors of ink, respectively. Then, when the main tank 204 is installed on the ink supply unit 205, it is made possible to supply independently ink of each color contained in the main tank 204 to each of the nozzle arrays of the recording head 201.

In the non-recording area, which is an area within the range of reciprocation of the recording head 201, but outside the range of the passage for a recording sheet S passage, a recovery unit 207 is arranged to face the ink discharge surface of the recording head 201.

Figure 2:
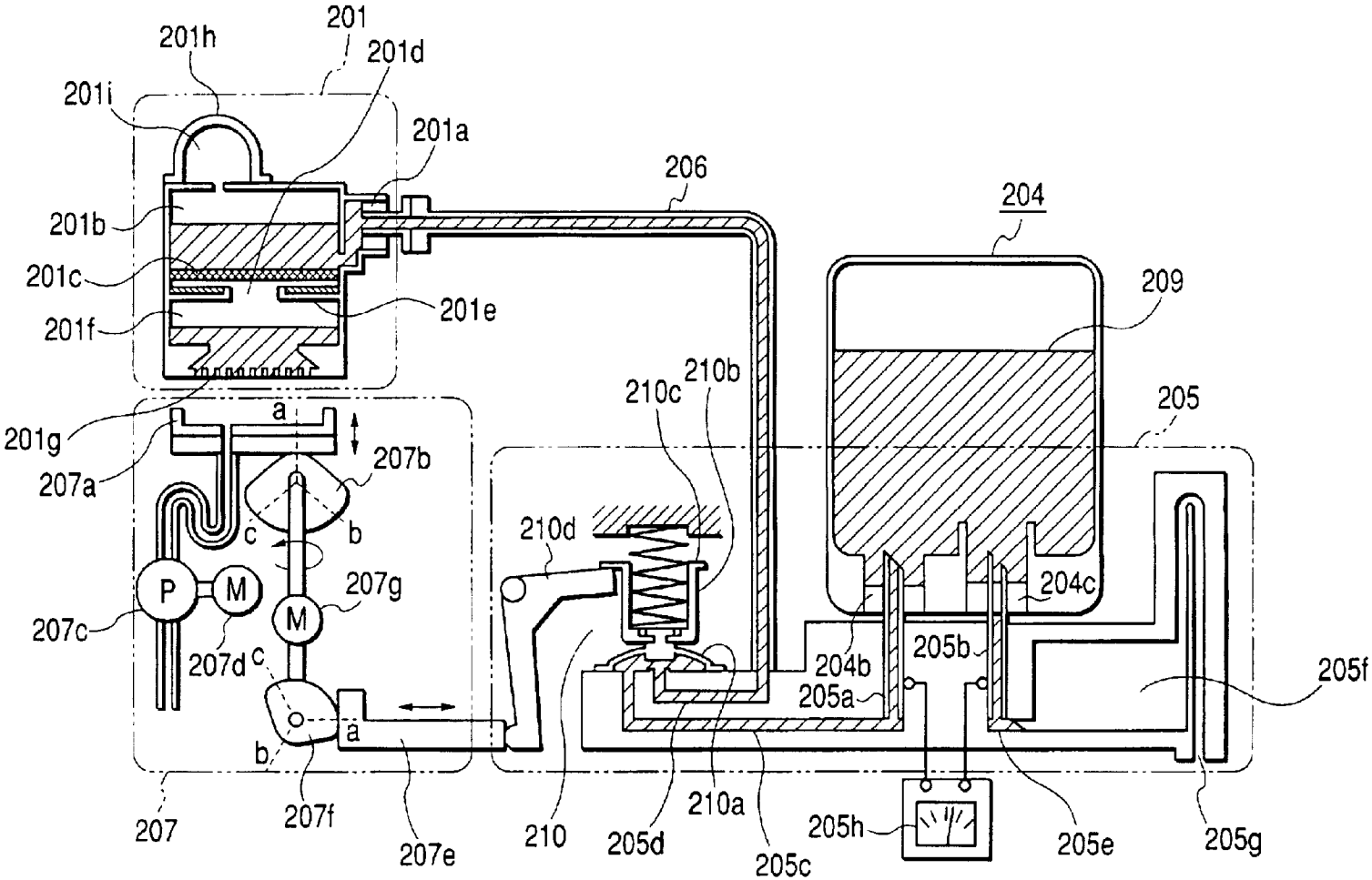
FIG. 2 is a view that illustrates the ink supply path for one color portion of the ink jet recording apparatus represented in FIG. 1.

Next, with reference to FIG. 2, the description will be made of the details of the structure of the ink supply system of this ink jet recording apparatus. FIG. 2 is a view that illustrates the ink supply path of the ink jet recording apparatus shown in FIG. 1, and to simplify the description, the path of only one-color portion is represented.

At first, the description will be made of the recording head 201.

To the recording head 201, ink is supplied through the connector inlet port 201*a* to which a liquid connector installed on the leading end of the ink supply tube 206 is connected. The connector inlet port 201*a* is communicated with the sub-tank portion 201*b* formed on the upper part of the recording head 201. Below the sub-tank portion 201*b*, there is formed the liquid chamber 201*f*, which supplies ink directly to the nozzle portion provided with plural nozzles 201*g* arranged in parallel. The sub-tank portion 201*b* and the liquid chamber 201*f* are divided by a filter 201*c*, but a partition 201*e*, which is provided with an opening 201*d*, is arranged on the boundary between the sub-tank portion 201*b* and the liquid chamber 201*f*. The filter 201*c* is installed on this partition 201*e*.

With the structure described above, ink supplied to the recording head 201 through the connector inlet port 201*a* is supplied to the nozzle 201*g* by way of the sub-tank portion 201*b*, the filter 201*c*, and the liquid chamber 201*f*. It is necessary to keep the passage between the connector inlet port 201*a* and the nozzle 201*g* to be airtightly closed to the air outside.

An opening is formed on the upper face of the sub-tank portion 201*b*, and this opening is covered by a dome type elastic member 201*h*. The space surrounded by this elastic member 201*h* (a pressure adjustment chamber 201*i*) changes its volume in accordance with the pressure inside the sub-tank portion 201*b*, and it has a function to adjust the pressure inside the sub-tank portion 201*b* to be described later.

The nozzle 201*g* is cylindrically formed in a sectional width of approximately 20 μm, and ink is discharged from the nozzle 201*g* with the discharge energy given to ink in the nozzle 201*g*. After ink is discharged, ink is filled in the nozzle 201*g* by capillary force of the nozzle 201*g*. Usually, this discharge is repeated at a cycle of 20 kHz or more so as to form fine images at high speed. For the provision of discharge energy for ink in the nozzle 201*g*, the recording head 201 has energy generating means per nozzle 201*g*. For the present embodiment, heat generating resistive element is used as energy generating means to give heat to ink in the nozzle 201*g*. Heat generating element is selectively driven in accordance with command from a head control unit (not shown) that controls the driving of the recording head 201. Then, ink in a desired nozzle 201*g* is given film boiling for discharge ink from the nozzle 201*g* by the utilization of the pressure of bubble thus generated.

The nozzle 201*g* is arranged with the ink discharging tip downward, but there is no valve mechanism provided for closing such tip. Ink is filled in the nozzle 201*g* in a state where meniscus is formed. Therefore, the inside of the recording head 201, particularly inside the nozzle 201*g*, is kept in a state of being negatively pressurized. However, if the negative pressure is too small, the meniscus of ink is broken should foreign substance or ink adhere to the tip of the nozzle 201*g*, thus allowing ink to leak from the nozzle 201*g* in some cases. Also, if the negative pressure is too large on the contrary, the force that pulls back ink into the nozzle 201*g* is made stronger than the energy given to ink at the time of discharge, hence bringing about discharge defects. Under the circumstances, the negative pressure in the nozzle 201*g* should be kept within a specific range, which is slightly lower than the atmospheric pressure. This range of negative pressure is different depending on the number of nozzles 201*g*, the sectional area, the performance of heat generating resistive element, and others. However, according to the results of experiments, such ranges should preferably be −40 mmAq (approximately −0.0040 atm=−4.053 kPa) to −200 mmAq (approximately −0.0200 atm=−2.0265 kPa) (provided that the specific gravity of ink is assumed to be nearly equal to the specific gravity of water).

For the present embodiment, the ink supply unit 205 and the recording head 201 are connected by the ink supply tube 206, and the position of the recording head 201 can be set comparatively freely with respect to the ink supply unit 205. Then, in order to negatively pressurize the inside of the recording head 201, the position of the recording head 201 is arranged to be higher than the ink supply unit 205. As regards this height, detailed description will be made later.

The filter 201*c* is formed by a metal mesh having fine holes of 10 μm or less, which is smaller than the sectional width of the nozzle 201*g*, in order to prevent the foreign substance that may clog the nozzle 20*g* from flowing from the sub-tank portion 201*b* to the liquid chamber 201*f*. The filter 201*c* is characteristically structured so that when ink is in contact with only one surface side of the filter 201*c*, each fine hole forms meniscus of ink by the capillary force thereof and allows ink to be filtered out easily, but makes it difficult for the air to flow. The finer the size of hole, the stronger becomes the meniscus, thus making it more difficult for the air to pass.

For a filter 201*c* of the kind used for the present embodiment, the pressure needed to filter out the air is approximately 0.1 atm (10.1325 kPa) (an experimental value). Therefore, even if the air exists in the liquid chamber 201*f*, which is positioned on the downstream side of the filter 201*c* in the flowing direction of ink in the recording head 201, the air in the liquid chamber 201*f* remains in the liquid chamber 201*f*, because the air cannot pass the filter 201*c* only by the flowing force of the air itself. The present embodiment utilizes this phenomenon, and the liquid chamber 201*f* is not filled with ink completely, but only a specific amount of ink is retained in the liquid chamber 201*f* so that the air layer should exist between ink in the liquid chamber 201*f* and the filter 201*c*.

The amount of ink retained in the liquid chamber 201*f* is an amount good enough to fill the nozzle 201*g* with ink at the minimum. If the air enters the nozzle 201*g* from the liquid chamber 201*f*, ink cannot be replenished ink in the nozzle 201*g* after discharging ink, thus bringing about discharge defects. Therefore, inside the nozzle 201*g*, ink should be filled with ink at all times.

With the upper face of the filter 201*c*, ink in the sub-tank portion 201*b* is in contact, and this area in contact with ink is the effective area of the filter 201*c*. As described in conjunction with the conventional art, the pressure loss due to the existence of the filter 201*c* depends on the effective area of the filter 201*c*. For the present embodiment, the filter 201*c* is arranged to be horizontal in the use condition of the recording head 201 so as to allow ink to be in contact with the enter upper face of the filter 201*c*, hence making the effective area of the filter available at the maximum. In this way, the pressure loss is made lower.

The pressure adjustment chamber 201*i* is a chamber the volume of which is made smaller as the inner negative pressure increases. For the pressure adjustment chamber 201*i*, which is formed by an elastic member 201*h* as the present embodiment, it is preferable to use rubber material or the like for the elastic member 201*h*. Aside from the elastic member 201*h*, it may be possible to combine a plastic sheet and a spring to form a member. The volume of the pressure adjustment chamber 201*i* is established depending on the temperature of environment under which the recording head 201 is used, the volume of the sub-tank portion 201*b*, and the like. For the present embodiment, it is established at approximately 0.5 ml.

In a case where no pressure adjustment chamber 201*i* is provided, the inner pressure of the sub-tank portion 201*b* is affected directly by resistance due to the pressure loss occurring when ink passes the main tank 204, the ink supply unit 205, and the ink supply tube 206. Therefore, the ink, which is supplied to the recording head 201, becomes short against ink to be discharged in a case of the so-called high duty where ink is discharged at a high rate, such as discharge from all the nozzles 201*g*. As a result, the negative pressure rises abruptly eventually. If the negative pressure of the nozzle 201*g* exceeds the aforesaid limited value of −200 mmAq (approximately −2.0265 kPa), discharges become instable to cause drawbacks in forming images.

For a recording apparatus of serial type as in the present embodiment, there exists a status where ink discharge is suspended when the carriage 202 (see FIG. 1) turns the other way even when forming images at high duty. Then, the pressure adjustment chamber 201*i* functions as if a capacitor so as to make its volume smaller during ink discharge to ease the rising of the inner negative pressure of the sub-tank portion 201*b*, and then, restores to its original condition when turned over.

For example, it is assumed that ink supplied for discharge ink is short by $\Delta V=0.05$ ml, provided that the changing ratio of negative pressure with respect to the voluminal contraction of the pressure adjustment chamber 201*i* is $K=-1.01325$ kPa/ml, and the volume of the sub-tank portion 201*b* is $V_s=2$ ml. In this case, if there is no pressure adjustment chamber 201*i*, the change of inner negative pressure of the sub-tank portion 201*b* becomes $\Delta P=V_s/(V_s+\Delta V)-1=-2.270$ kPa because of the principle of "PV=constant". Then, this exceeds the aforesaid limited value to make the discharges instable. In contrast, if there is the pressure adjustment chamber 201*i*, it is $\Delta P=K\times\Delta V=-0.507$ kPa, hence suppressing negative pressure to rise to make stable discharges possible.

As described above, with the provision of the pressure adjustment chamber 201*i*, it is possible to implement the stabilization of ink discharge, while suppressing the influence of pressure loss in the ink supply passage from the main tank 204 to the recording head 201. As a result, it becomes possible to use an ink supply tube 206 of small diameter that follows the movement of the carriage 202, thus contributing to reducing the load when the carriage 202 moves, too.

Next, the description will be made of the ink supply unit 205 and the main tank 204.

The main tank 204 is formed to be attachable to and detachable from the supply unit 205, which is provided with an ink supply port airtightly closed with a rubber plug 204*b* and an air induction inlet port airtightly closed with a rubber plug 204*c* at the bottom end thereof. The main tank 204 is an airtight container by itself, and ink 209 is contained in the main tank 204 as it is.

On the other hand, the ink supply unit 205 is provided with the ink supply needle 205*a*, which draws out ink 209 from the main tank 204, and the air induction needle 205*b* for inducing the air outside into the main tank 204. The ink supply needle 205*a* and the air induction needle 205*b* are hollow both of them, and arranged with the needle tips upward corresponding to the positions of the ink supply port and air induction inlet port of the main tank 204. When the main tank 204 is installed on the ink supply unit 205, the ink supply needle 205*a* and the air induction needle 205*b* penetrate rubber plugs 204*b* and 204*c*, respectively. The structure is thus arranged so that these needles enter the inside of the main tank 204.

The ink supply needle 205*a* is connected with the ink supply tube 206 by way of the liquid path 205*c*, the cut-off valve 210, and the liquid path 205*d*. The air induction needle 205*b* is communicated with the air outside by way of the liquid path 205*e*, the buffer chamber 205*f*, and the atmosphere communication port 205*g*. The flow path 205*c*, which is positioned lowest in the ink supply passage from the ink supply needle 205*a* to the ink supply tube 206, and the liquid path 205*e*, which is positioned lowest in the passage from the air induction needle 205*b* to the atmosphere communication port 205*g* are arranged at the same height both of them. The ink supply needle 205*a* and the air induction needle 205*b* used for the present embodiment are those having a thicker inner diameter of 1.6 mm in order to suppress the flow resistance of ink, and the needle hole diameter thereof is 1 to 1.5 mm, respectively.

The cut-off valve 210 is provided with a rubber diaphragm 210*a*. The diaphragm 210*a* is displaced to open or close the passage between two liquid flow paths 205*c* and 205*d*. On the upper surface of the diaphragm 210*a*, a cylindrical spring holder 210*b* is installed to hold a compression spring 210*c* therein. When the compression spring 210*c* compresses the diaphragm 210*a*, the passage between the liquid flow paths 205*c* and 205*d* is cut off. The spring holder 210*b* is provided with a flange with which a lever 210*d* engages when driven by the link 207*e* of a recovery unit 207 to be described later. With the operation of the lever 210*d*, the holder 210*b* is lifted against the spring force of the compression spring 210*c*. Then, the liquid paths 205*c* and 205*d* are communicated. The cut-off valve 210 is open in a state where the recording head 201 discharges ink, and closed where it is on standby or at rest. Then, at the time of filling ink, which will be described later, this valve is open or closed in agreement with the timing of the recovery unit 207. The structure of the ink supply unit 205 described above is arranged per main tank 204, that is, per ink color with the exception of the lever 210*d*. The lever 210*d* is shared for use all the colors, and the cut-off valve is open or closed simultaneously for all the colors.

With the structure thus arranged, ink is supplied to the recording head 201 from the main tank 204 through the ink supply unit 205 and the ink supply tube 206 whenever ink in the recording head 201 is consumed. At this juncture, the same amount of air as that of ink supplied from the main tank 204 is inducted into the main tank 204 from the atmosphere communication port 205*g* through the buffer chamber 205*f* and the air induction needle 205*b*.

The buffer chamber 205*f* is a space that provisionally retains ink flowing out from the main tank 204 due to the expansion of air in the main tank 204, and the lower end of the air induction needle 205*b* is positioned at the bottom portion of the buffer chamber 205*f*. When the air in the main tank 204 should expand by the rise of the environmental temperature, the decrease of the outer atmosphere, or the like, while an ink jet recording apparatus is on standby or at rest, the cut-off valve 210 is closed. As a result, ink in the main tank 204 flows out to the buffer chamber 205*f* from the air induction needle 205*b* through the liquid path 205*e*. On the contrary, if the air in the main tank 204 is contracted due to the decrease of the environmental temperature or the like, ink that has flown out to the buffer chamber 205*f* returns to the main tank 204. Also, if ink is discharged from the recording head 201 in a state where ink exists in the buffer chamber 205*f*, ink in the buffer chamber 205*f* returns to the main tank 204 at first, and then, the air is inducted into the main tank 204 after ink in the buffer chamber 205*f* no longer exists.

The volume Vb of the buffer chamber 205*f* is defined to satisfy the use environment of a product. For example, if it is assumed that a product is used within a range of temperatures of 5° C. (278 K) to 35° C. (308 K), the $V_b$=100×(308−278)/308=9.7 ml or more, provided that the volume of the main tank 204 is 100 ml.

Here, in conjunction with FIGS. 3A to 3D, the description will be made of the basic water head of the main tank 204, and the behavior of the air and ink in the flow path of the ink supply unit 205 when the air is inducted into the main tank 204.

Figure 3A:
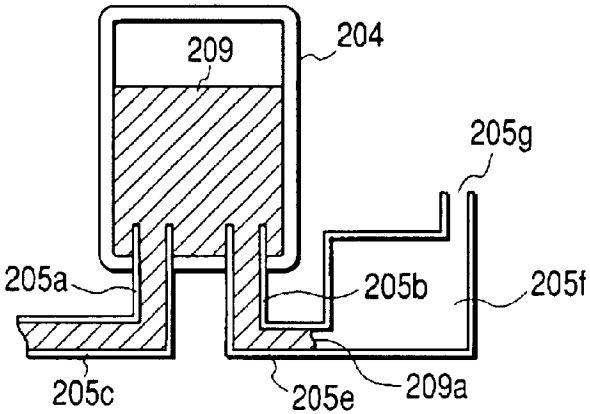
FIGS. 3A, 3B, 3C and 3D are views that illustrate the behavior of the air and ink in the flow path of an ink supply unit when the air is induced into the main tank in the ink flow path shown in FIG. 2.

FIG. 3A shows the usual state where ink can be supplied from the main tank 204 to the recording head 201 (see FIG. 2). In this state, the inside of the main tank 204 is airtight with the exception of the buffer chamber 205*f*. Therefore, the inside of the main tank 204 is kept negatively pressurized, and the head 209*a* of ink stays on the way of the liquid flow path 205*e*. The pressure at the head 209*a* of ink is the atmospheric pressure (=0 mmAq), because it is in contact with the air outside. The liquid flow 205*c* in which the head 209*a* of ink is positioned, and the liquid path 205*e* communicated with the ink supply tube 206 (see FIG. 2) are at the same height, and both liquid paths 205*c* and 205*e* are communicated only by means of ink. Therefore, the pressure of the liquid path 205*c* also becomes the atmospheric pressure. This is determined only by the height relations between the head 209*a* of ink and the liquid path 205*c*, and there is no influence at all by the amount of ink 209 in the main tank 204.

Figure 3B:
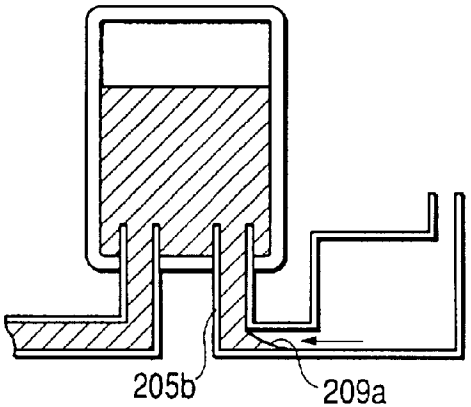
Figure 3C:
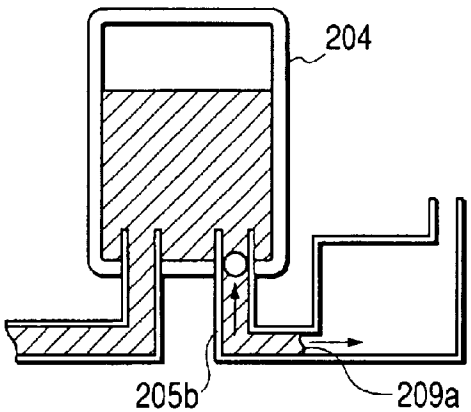

When ink in the main tank 204 is consumed, the head 209*a* of ink gradually moves toward the air induction needle 205*b* as shown in FIG. 3B, and when it reaches immediately below the air induction needle 205*b*, it becomes a bubble as shown in FIG. 3C and rises in the air induction needle 205*b*, thus being induced into the main tank 204. In place thereof, ink in the main tank 204 enters the air induction needle 205*b*, and the head 209*a* of ink returns to the original state as shown in FIG. 3A.

Figure 3D:
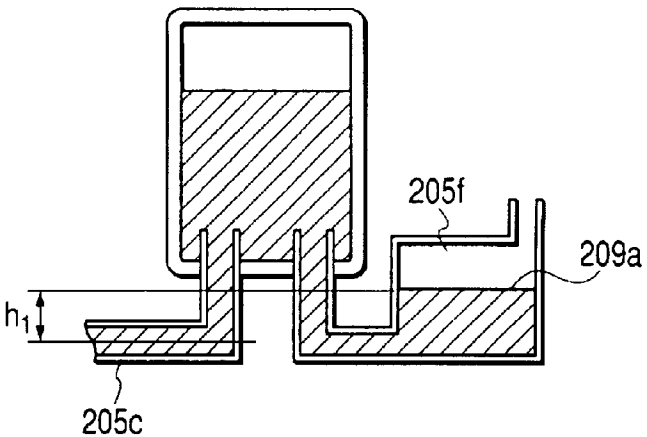

FIG. 3D shows a state where ink is gathered in the buffer chamber 205*f*. In this case, the head 209*a* of ink is in the position higher than the liquid path 205*c* by h1 (mm) in the middle of the buffer chamber 205*f* in the height direction, and the pressure of the liquid path 205*c* is −h1 (mmAq).

Figure 4:
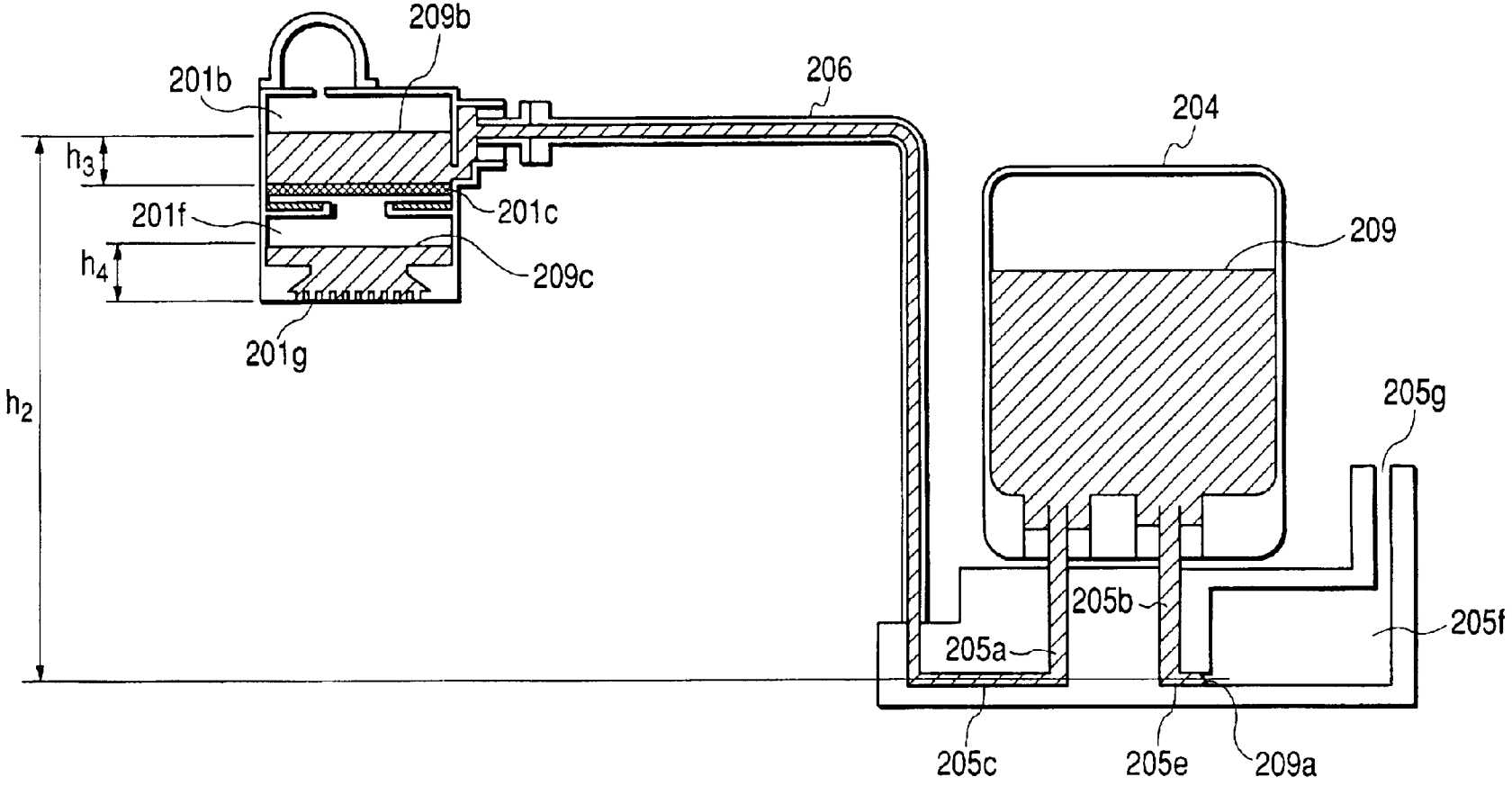
FIG. 4 is a view that illustrates the pressure exerted on the nozzle by the water head difference in the ink supply path shown in FIG. 2.

As described above, in accordance with the present embodiment, the pressure exerted on the nozzle 201*g* (see FIG. 2) by the water head difference presents a negative pressure $P_n$ at the lower end of the nozzle 201*g* to be $P_n$ is nearly equal to −(h2−h3−h4) mmAq in the usual state, and $P_n$ equal to (h2−h1−h3−h4) mmAq in a state where ink is gathered in the buffer chamber 205*f*, provided that the height from the flow path 205*c* to the upper face 209*b* of ink in the sub-tank portion 201*b* is h2 (mm); the height from the filter 201*c* to the upper face 209*b* of ink in the sub-tank portion 201*b* is h3 (mm); and the height from the lower end of the nozzle 201*g* to the upper face of ink 209*c* of ink in the liquid chamber 201*f* is h4 (mm) as shown in FIG. 4. The value of $P_n$ is defined so as to be within a range of negative pressure (−40 mmAq to −200 mmaq) as described earlier.

Here, as shown in FIG. 2, it is made possible to detect the presence and absence of ink in the main tank 204 by the connection of a circuit 205*h* to the ink supply needle 205*a* and the air induction needle 205*b*, which is arranged to measure the electric resistance of ink. The circuit 205*h* detects an electric close in a state where ink is present in the main tank 204, because electric current runs on the circuit 205*h* through ink in the main tank 204, and detects an electric open in a state where no ink is present or the main tank 204 is not installed. The detecting current is extremely weak. Therefore, insulations of the ink supply needle 205*a* and the air induction needle 205*b* are important. In accordance with the present embodiment, the passage from the ink supply needle 205*a* to the recording head 201, and the passage from the air induction needle 205*b* to the air communication port 205*g* are arranged to be completely independent, and careful consideration is given so that the electric resistance of only ink in the main tank 204 is made measurable.

Next, the recovery unit 207 will be described.

The recovery unit 207 executes the suction of ink and air from the nozzle 201*g*, and the opening and closing of the cut-off valve 210, which is provided with a suction cap 207*a* that caps the ink discharge surface (the surface to which the nozzle 201*g* is open) of the recording head 201, and a link 207*e* that operates the lever 210*d* of the cut-off valve 210.

At least the portion of the suction cap 207*a*, which is in contact with the ink discharge surface, is formed by an elastic member, such as rubber, and arranged to be movable between the position where the ink discharge surface is airtightly closed and the position where it retracts from the recording head 201. To the suction cap 207*a*, a tube is connected, with a tube type suction pump 207*c* being provided on the mid way thereof. When the suction pump 207*c* is driven by a pump motor 207*d*, a continuous suction is made possible. Also, the suction amount is made changeable corresponding to the rotational amount of the pump motor 207*d*. For the present embodiment, a suction pump 207*c* that can reduce pressure to 0.4 atm (40.53 kPa) is used.

A cam 207*b* enables the suction cap 207*a* to move, which rotates by a cam control motor 207*g* in synchronism with the cam 207*f* that operates the link 207*e*. The timing at which the positions a to c of the cam 207*b* are in contact with the suction cap 207*a*, respectively, is identical to the timing at which the positions a to c of the cam 207*f* are in contact with the link 207*e*, respectively. In the position at a, the cam 207*b* enables the suction cap 207*a* to retract from the ink discharge surface of the recording head 201, and the cam 207*f* pushes the link 207*e* to raise the lever 210*d*, and also, opens the cut-off valve 210. In the position at b, the cam 207*b* enables the suction cap 207*a* to be airtightly in contact with the ink discharge surface, and the cam 207*f* pulls back the link 207*e* to close the cut-off valve. In the position at c, the cam 207*b* enables the suction cap 207*a* to be airtightly in contact with the ink discharge surface, and the cam 207*f* pushed the link 207*e* to open the cut-off valve 210.

When a recording operation is performed, the cams 207*b* and 207*f* are positioned at a, thus making it possible to discharge ink from the nozzle 201*g*, and supply ink from the main tank 204 to the recording head 201. At the time of non-operation including being on standby and at rest, the cams 207*b* and 207*f* are positioned at b so as to prevent the nozzle 102*g* from being dried, while preventing ink from flowing out from the recording head 201 (there may be a case where ink flows out if an apparatus is inclined particularly when relocating the apparatus itself). The position c of the cams 207*b* and 207*f* is used for filling ink in the recording head 201 as described hereunder.

So far, the description has been made of the ink supply passage from the main tank 204 to the recording head 201. However, with a structure of the kind as shown in FIG. 2, the air is accumulated in the recording head 201 inevitably in a long run.

In the sub-tank portion 201*b*, the air that permeates and enters the ink supply tube 206 and the elastic member 201*h*, and the air dissolved into ink are accumulated. As to the air that permeates the ink supply tube 206 and the elastic member 201*h*, it may be possible to use the material having high gas barrier property for forming them. However, a material having high gas barrier property is expensive, and for equipment of civil use that may be produced in a large scale, it is not easy to use such high-performance material from the viewpoint of costs. For the present embodiment, a low-cost, highly flexible, and easy to use polyethylene tube is used for the ink supply tube 206, and butyl rubber for the elastic member 201*h*.

On the other hand, in the liquid chamber 201*f*, the bubble, which is generated by film boiling when ink is discharged from the nozzle 201*g*, may be broken and return to the liquid chamber 201*f* or bubbles are dissolved in ink to present minute bubbles, which get together in the nozzle 201*g* as the temperature of ink rises and become a large bubble, thus accumulating the air gradually.

According to experiments, the amount of air accumulation in the sub-tank portion 201*b* is approximately 1 ml per month, and the amount of air accumulation in the liquid chamber 201*f* is approximately 0.5 ml per month in the structure shown in the present embodiment.

If the amounts of air accumulations in the sub-tank portion 201*b* and the liquid chamber 201*f* are too large, the amount of ink retained in the sub-tank portion 201*b* and the liquid chamber 201*f* are reduced inevitably. If ink is short in the sub-tank portion 201*b*, the filter 201*c* is exposed to the air, thus reducing the effective area of the filter 201*c*. As a result, the pressure loss of the filter 201*c* is increased eventually. In the worst case, the ink supply to the liquid chamber 201*f* is disabled. In the liquid chamber 201*f*, on the other hand, if the upper end of the nozzle 201*g* is exposed to the air, the ink supply to the nozzle 201*g* becomes disabled. Like this, a fetal problem is encountered if ink of a specific amount or more is not retained in the sub-tank portion 201*b* and the liquid chamber 201*f*, either of them.

Therefore, an appropriate amount of ink is refilled in each of the sub-tank portion 201*b* and the liquid chamber 201*f* per specific period. In this manner, it becomes possible to maintain the ink discharge function for a long time even without using material having high gas barrier property. For the present embodiment, for example, it should be good enough if only ink is filled in the sub-tank portion 201*b* and the liquid chamber 201*f*, respectively, in an amount per month equivalent to the amount of air accumulated per month plus an amount of variation at the time of filling.

Here, the suction operation by the recovery unit 207 is utilized to fill ink in the sub-tank portion 201*b* and the liquid chamber 201*f*. In other words, the suction pump 207*c* is driven in a state where the ink discharge surface of the recording head 201 is airtightly closed by the suction cap 207*a* to ink in the recording head 201 is sucked from the nozzle 201*g*. However, if ink is just sucked out from the nozzle 201*g*, ink in an amount substantially equal to the amount of ink sucked from the nozzle 201*g* is allowed to flow into the liquid chamber 201*f* from the sub-tank portion 201*b*. Likewise, ink in an amount substantially equal to the amount of ink flowing out from the sub-tank portion 201*b* is allowed to flow into the sub-tank portion 201*b* from the main tank 204. The situation does not change much from the one prior to such suction operation.

Therefore, in accordance with the present embodiment, the cut-off valve 210 is utilized to reduce pressures in the sub-tank portion 201*b* and in the liquid chamber 201*f* to the specific ones, respectively, so as to set the volumes of the sub-tank portion 201*b* and the liquid chamber 201*f* in order to fill ink in the sub-tank portion 201*b* and the liquid chamber 201*f*, which are partitioned by the filter 201*c*, each in an appropriate amount.

Hereunder, the description will be made of the filling operation of ink to the sub-tank portion 201*b* and the liquid chamber 201*f*, and the volume setting therefor as well.

For the execution of ink filling operation, the carriage 202 (see FIG. 1) moves at first to the position where the recording head 201 faces the suction cap 207*a*. Then, the cam control motor 207*g* of the recovery unit 207 is driven to rotate the cams 207*b* and 207*e* until the positions thereof at b are in contact with the suction cap 107*a* and the link 207*e*, respectively. In this way, the ink discharge surface of the recording head 201 is airtightly closed by the suction cap 207*a*, and the cut-off valve 210 presents condition that the ink passage from the main tank 204 to the recording head 201 is closed.

In this state, the pump motor 207*d* is driven to enable the suction pump 207*c* to perform suction from the suction cap 207*a*. With this suction, ink and air remaining in the recording head 201 are sucked through the nozzle 201*g*, thus reducing the inner pressure of the recording head 201. When the amount of suction by the suction pump 207*c* reaches a designated amount, the suction pump 207*c* is suspended, and the cam control motor 207*g* is driven to enable the cams 207*b* and 207*f* to rotate until the positions thereof at c are in contact with the suction cap 207*a* and the link 207*e*, respectively. In this way, while the ink discharge surface is airtightly closed by the suction cap 207*a* as it is, the cut-off valve 210 is open. The suction amount of the suction pump 207*c* is a suction amount that makes the inner pressure of the recording head 201 a specific amount required to fill an appropriate amount of ink in the sub-tank portion 201*b* and the liquid chamber 201*f*, respectively. This can be obtained by calculation, experiments, or the like.

When pressure inside the recording head 201 is reduced, ink flows into the recording head 201 through the ink supply tube 206, and ink is filled in the sub-tank portion 201*b* and the liquid chamber 201*f*, respectively. The amount of ink to be filled should have a volume that enables the sub-tank portion 201*b* and the liquid chamber 201*f*, the inner pressures of which have been reduced, to restore them substantially to the atmospheric pressure, respectively. By the capacities and pressures of the sub-tank portion 201*b* and the liquid chamber 201*f*, such volume is determined, respectively.

It takes approximately one second to complete the ink filling to the sub-tank portion 201*b* and the liquid chamber 201*f* after the cut-off valve 210 has been open. With the completion of ink filling, the cam control motor 207*g* is driven to rotate the cams 207*b* and 207*f* until the positions at b to be in contact with the suction cap 207*a* and the link 207*e*. In this way, the suction cap 207*a* retracts from the recording head 201. Then, the suction pump 207*c* is driven again to suck ink remaining in the suction cap 207*a*. Also, in this state, it becomes possible to form characters, images, and the like on a recording sheet S (see FIG. 1) by discharging ink from the nozzle 201*g*, because the cut-off valve 210 is conditioned to be open. Here, in a case of being on standby or at rest, the cam motor 207*g* is again driven to rotate the cams 207*b* and 207*f* until the positions at b are in contact with the suction cap 207*a* and link 207*e*, thus closing the cut-off valve 210, while airtightly closing the ink discharge surface of the recording head 201 with the suction cap 207*a*.

If the amount of ink in the sub-tank portion 201*b* and the liquid chamber 201*f* does not become insufficient for a long time, there is no need for the recovery unit 207 to frequently perform the suction operation, and the event in which ink is used wastefully occurs less frequently. Further, when ink should be filled in the sub-tank portion 201*b* and the liquid chamber 201*f*, only one-time filling operation is good enough to serve the purpose. Therefore, it is possible to save ink accordingly. Here, given the volume of the sub-tank portion 201*b* as V1; the amount of ink to be filled in the sub-tank portion 201*b* as S1; and pressure inside the sub-tank portion 201*b* as P1 (a relative value to the atmospheric pressure), the relations between them are defined to be V1=S1/|P1| by the principle of "PV=constant", thus making it possible to fill an appropriate amount of ink in the sub-tank portion 201*b* by the filling operation. Likewise, given the volume of the liquid chamber 201*f* as V2; the amount of ink to be filled in the liquid chamber 201*f* as S2; and pressure inside the liquid chamber 201*f* as P2 (a relative value to the atmospheric pressure), the relations between them are defined to be V2=S2/|P2|, thus making it possible to fill an appropriate amount of ink in the liquid chamber 201*f* by the filling operation.

Also, the filter 201*c* that divides the sub-tank 201*b* and the liquid chamber 201*f* is of a fine mesh structure, and as described earlier, it has a property that makes the air flow difficult in a state of meniscus being formed. Here, pressure needed to enable the air to pass the filter 201*c* having meniscus formed therefor is given as Pm. When the nozzle 201*g* sucked by the recovery unit 207, the pressure P2 inside the liquid chamber 201*f* is made lower than the pressure P1 in the sub-tank portion 201*b* by the aforesaid pressure Pm, because the air in the sub-tank portion 201*b* is caused to pass the filter 201*c*. Therefore, it is easy to determine the conditions of filling operation by the application of this relationship when determining the volumes of the sub-tank portion 201*b* and the liquid chamber 201*f*.

Here, the description will be made of specific examples of the aforesaid filling operation and volume setting.

Ink is filled once a month, and the amount of air accumulation during a month is 1 ml in the sub-tank portion 201*b* and 0.5 ml in the liquid chamber 201*f*. Also, it is assumed that the amount of ink needed in the sub-tank portion 201*b* so as not to allow the filter 201*c* to the air is 0.5 ml, and the amount of ink needed in the liquid chamber 201*f* so as not to allow the nozzle 201*g* to discharge the air is 0.5 ml, and that the variations of ink filling amounts is each 0.2 ml in the sub-tank portion 201*b* and the liquid chamber 201*f*. These numerical values are obtained by experiments. With these in view, the amount of ink to be filler per one-time filling is the total sum thereof, and set at 1.7 ml for the sub-tank portion 201*b* and 1.2 ml for the liquid chamber 201*f*.

The reduced pressure inside the recording head 201 is defined within a range not to exceed the capability of the recovery unit 207. In accordance with the present embodiment, the capability limit of the suction pump 207*c* is −0.6 atm (−60.795 kPa), and the suction amount of the suction pump 207*c* is obtained and established by experiments for controlling the rotational amount of the pump motor 207*d* so that the inner pressure of the suction cap 207*s* becomes −0.5 atm (−50.6625 kPa) with a margin given thereto.

Here, the experimental value is −0.05 atm (−5.06625 kPa) for the pressure needed to enable the air by meniscus of the nozzle 201*g* to pass, and there occurs a difference equivalent to the resistance of nozzle 201*g* between pressures inside the suction cap 207*a* and the liquid chamber 201*f*, and the pressure inside the liquid chamber 201*f* becomes higher than the pressure inside the suction cap 207*a* by 0.05 atm (5.06625 kPa). Likewise, the experimental value is −0.1 atm (−10.1325 kPa)) for the pressure needed to enable the air by meniscus of the filter 201*c* to pass, and there occurs a difference equivalent to the resistance of filter 201*c* between pressures inside the liquid chamber 201*f* and the sub-tank portion 201*b*, and the pressure inside the sub-tank portion 201*b* becomes higher than the pressure inside the liquid chamber 201*f* by 0.1 atm (10.1325 kPa). Therefore, if the pressure inside the suction cap 207*a* is set at −0.5 atm (−50.6625 kPa), the pressure inside the liquid chamber 201*f* is −0.45 atm (−45.5963 kPa), and the pressure inside the sub-tank portion 201*b* is −0.35 atm (−35.4638 kPa).

Now, in order to fill ink of 1.7 ml in the sub-tank portion 201*b*, the volume V1 of the sub-tank portion 201*b* should be defined so that the inner pressure becomes −0.35 atm (−35.4638 kPa) at the time of sucking ink by 1.7 ml from the sub-tank portion 201*b* the inner pressure of which is then almost 1 atm (101.325 kPa). In other words, V1=1.7/0.35=4.85 ml. Likewise, for the volume V2 of the liquid chamber 201*f*, the setting is made to make the V2=1.2/0.45=2.67 ml.

Under the conditions described above, the cut-off valve 210 is open after reducing the pressure in the recording head

201, thus enabling ink to flow into the recording head 201. To describe more precisely, ink flows into the sub-tank portion 201*b* at first. Then, the air that has expanded up to the V1 due to the reduced pressure restores substantially to the atmospheric pressure. At this time, given the volume of the air in the sub-tank portion 201*b* as $V1_a$, the $V1_a$=V1×(1−0.35)=3.15 ml. The sub-tank portion 201*b* is settled down when ink of $V1-V1_a$−1.7 ml is filled therein. Likewise, ink flows from the sub-tank portion 201*b* to the liquid chamber 201*f* to enable the air expanded up to the V2 due to the reduced pressure to restore to the atmospheric pressure. Then, given the volume of the air in the liquid chamber 201*f* as $V2_a$, the $V2_a$=V2×(1−0.45)=1.47 ml. The liquid chamber 201*f* is settled down when ink of $V2-V2_a$= 1.2 ml is filled therein.

With each of the volumes and the pressures to be reduced in the sub-tank portion 201*b* and the liquid chamber 201*f* being set as described above, it becomes possible to fill an appropriate amount of ink by one-time filling each in the sub-tank portion 201*b* and the liquid chamber 201*f*, which are partitioned by the filter 201*c*. Thus, even under the circumstance where the air is accumulated in the recording head 201, it is possible to perform the normal operation thereof for a long time without operating suction.

Also, the air layer inclusively exists between the filter 201*c* and the upper face of ink in the liquid chamber 201*f* as described earlier. It is possible to set the amount of this air layer arbitrarily by the suction pressure exerted in the suction operation of the recovery unit 207. In other words, the air layer is arranged to be controllable.

Therefore, the reliability is enhanced significantly against the conventional problem of discharge defects that may be caused by bubbles generated between the filter and the nozzle. In other words, regarding the problem encountered in the conventional art that uncontrollable bubbles exist under the filter, which causes the effective area of the filter to change (to decrease), the present embodiment is arranged to enable the filter 201*c* to be in contact with the air layer in the location controlled form the outset (the opening portion 201*d* in FIG. 1), and the effective area of the filter 201*c* does not change. Therefore, it is good enough if only this aspect is taken into design consideration from its stage.

Also, regarding the problem that bubbles may clog the flow path between the filter and nozzle, the sectional area of the liquid chamber 201*f* is formed large enough against the diameter of bubble that may exist in the liquid chamber 201*f*. Therefore, no bubble in the liquid chamber 201*f* may impede ink flow.

Further, regarding the problem that bubbles in the liquid chamber may enter the nozzle or clog the communicative portion between the liquid chamber and the nozzle, the sectional area of the liquid chamber 201*f* is large enough as described above so that the bubble generated in the liquid chamber 201*f* can rise in ink by its floating force in the liquid chamber 201*f*, thus being unified with the air layer. Therefore, it does not enter the nozzle 201*g*. Further, even if the bubble generated in the liquid chamber 201*f* unifies itself with the air layer, the effective area of the filter 201*c* does not change, because this air layer is controlled as described above.

Figure 5:
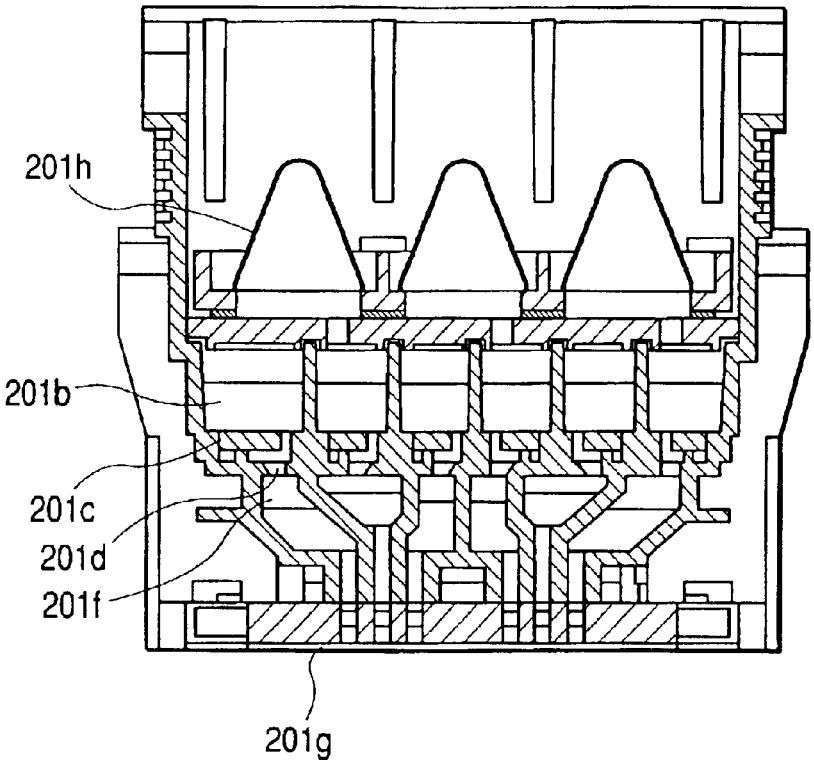
FIG. 5 is a cross-sectional view that shows the details of the structure of the recording head represented in FIG. 2.

In other words, the liquid chamber 201*f*, which is partitioned from the sub-tank portion 201*b* by use of the filter 201*c*, is structured as described above, to make it possible to enhance the reliability significantly against the discharge defects caused by the generation of bubbles in the liquid chamber 201*f* or by the movement of bubbles thus generated FIG. 5 is a cross-sectional view that shows the details of the structure of the recording head 201 represented in FIG. 2.

The cross-sectional view shown in FIG. 5 is the one illustrating the representation in FIG. 2, observed in the direction from the left to the right therein. The recording head 201 of the present embodiment discharges ink from six nozzles 201*g*, respectively, and each of the nozzles 201*g* is provided with the main tank 204 and the ink supply tube 206, respectively, as shown in FIG. 1. Ink is supplied to the nozzles each individually through the sub-tank portion 201*b* and the liquid chamber 201*f*.

Figure 6:
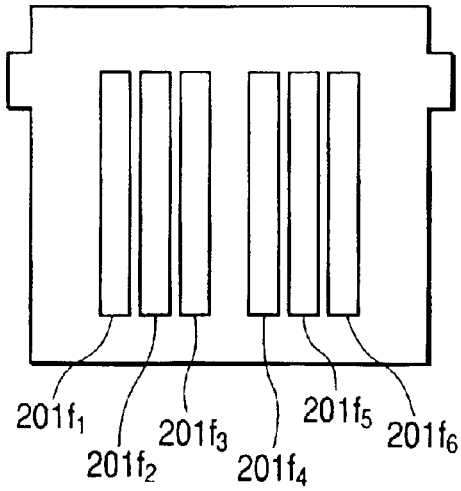
FIG. 6 is a bottom view of the recording head, observed from the nozzle side.

FIG. 6 is a bottom view of the recording head 201, observed from the nozzle 201*g* side.

The nozzle 201*g* has a plurality of recording element arrays in the longitudinal direction. For the present embodiment, six of them are provided (201$g_1$ to 201$g_6$). Also, the sub-tank 201*b* and the liquid chamber 201*f* are configured to provide the longitudinal direction parallel to the nozzle 201*g*.

For the present embodiment, each of the nozzles 201$g_1$ to 201$g_6$ has nozzles 201$g_1$ to 201$g_3$, and 201$g_4$ to 201$g_6$ as each set, respectively, and in each set, nozzles are arranged adjacent to each other. As a result, the width (the length in the left and right directions in FIG. 6) of the ink discharge surface of recording head is arranged to be shorter than the width regarding the sub-tank portion 201*b* group. This arrangement is to make the airtightly closed space of the ink discharge surface smaller for the suction cap 207*a*.

An ink jet recording apparatus of the present embodiment, which consumes a large amount of ink, needs a large capacity of the sub-tank portion 201*b*. Therefore, the width regarding the sub-tank 201*b* group is larger than that of the conventional one. If the nozzles 201$g_1$ to 201$g_6$, which receive ink from each sub-tank portion 201*b*, respectively, are arranged below each of the sub-tank portion 201*b*, the width of the ink discharge surface becomes larger accordingly. The airtightly closed space by the suction cap 207*a* on the ink discharge surface also becomes larger. The suction amount should also be larger eventually. Consequently, a suction pump required for the service is made also larger. The apparatus becomes larger as a whole inevitably. For the present embodiment, the width regarding the ink discharge surface is made smaller than the width regarding the sub-tank portion 201*b* group as described above, thus preventing the apparatus from being made larger.

For the present embodiment, each of the liquid chambers 201*f* that connects each of the sub-tank portion 201*b* and each of the nozzles 201*g* is arranged to expand radially from each of the nozzles 201*g* toward each of the sub-tank portions 201*b* in order to make the width of the ink discharge surface smaller than the width of the sub-tank portion 201*b* group. In this way, it is made possible to use the suction pump, which is equivalent to the conventional one, while attempting to arrange the discharge surface formed by a plurality of nozzle arrays to be commonly usable by a smaller ink jet recording apparatus, hence reducing the manufacturing costs.

Figure 7A:
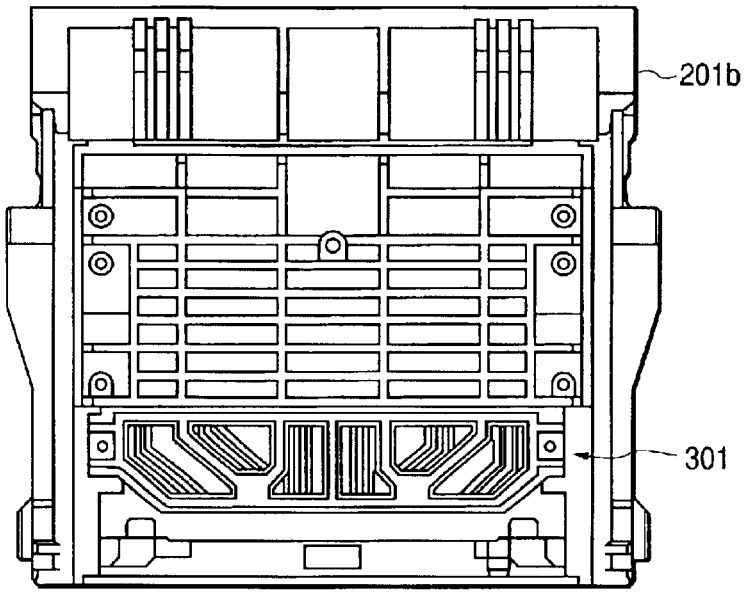
FIGS. 7A, 7B, and 7C are views that illustrate the structure of a sub-tank to which a flow path cover is bonded.
Figure 7B:
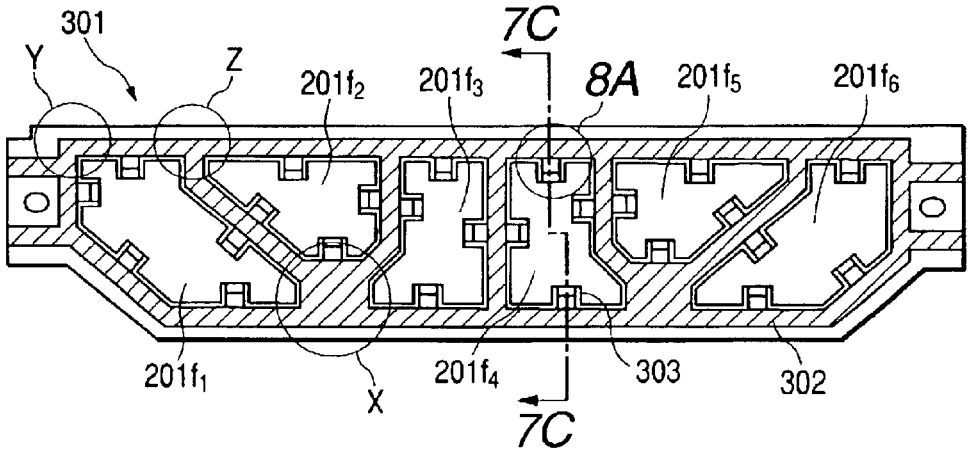
Figure 7C:
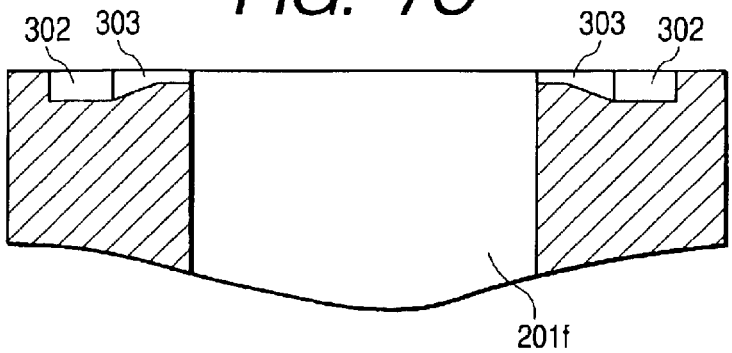
Figure 8B:
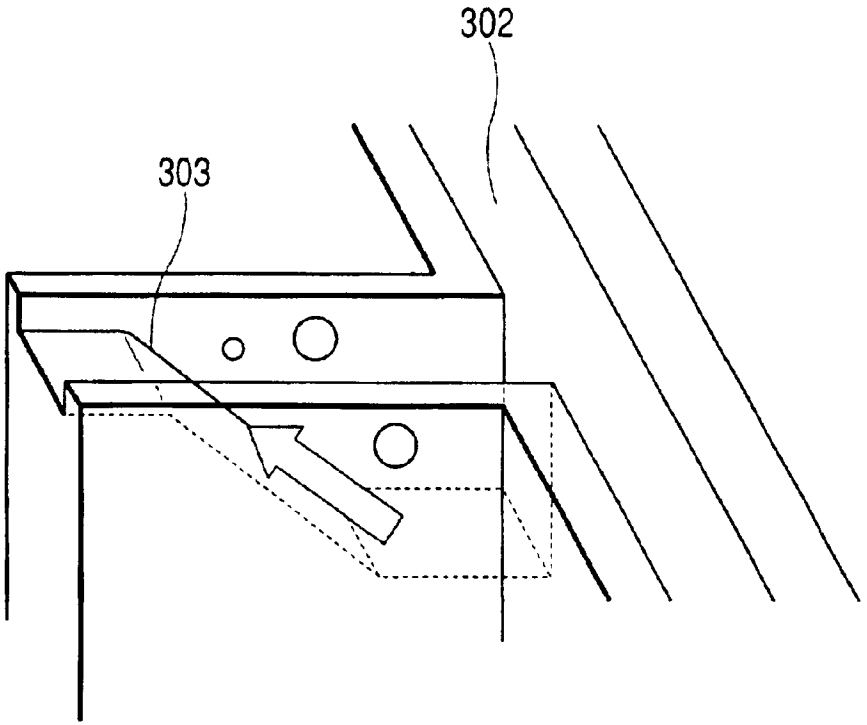
FIGS. 8A and 8B are views that illustrate the structure of the sub-tank to which a flow path cover is bonded.
Figure 8A:
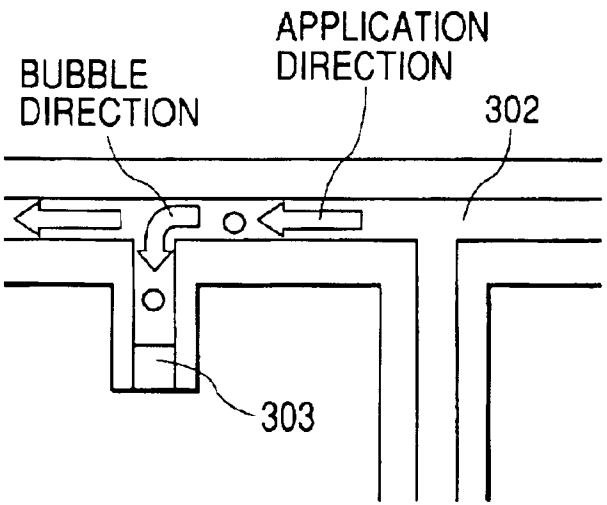

FIGS. 7A to 7C and FIGS. 8A and 8B are views that illustrate the structure of a sub-tank to which a flow path cover is bonded. FIG. 7A is a view that shows the sub-tank entirely, observed from the surface where the flow path cover is bonded. FIG. 7B is an enlargement of the portion where the flow path cover of the sub-tank shown in FIG. 7A. FIG. 7C is a cross-sectional view taken along line 7C—7C in FIG. 7B. Also, FIG. 8A is an enlargement of the 8A portion in FIG. 7B. FIG. 8B is a perspective view of the 8A portion in FIG. 7B.

Figure 9A:
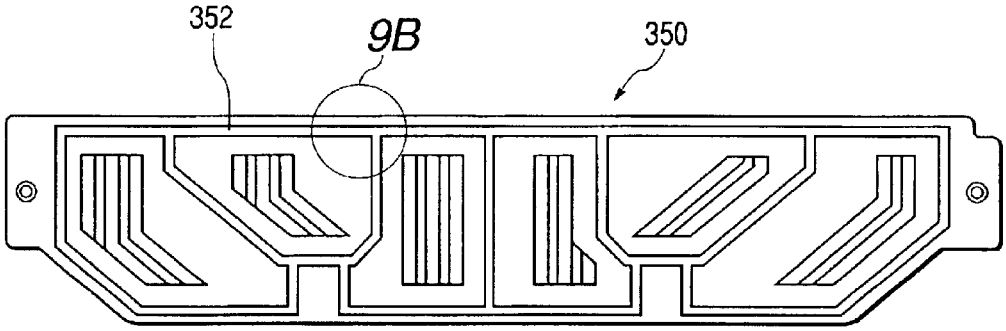
FIGS. 9A, 9B, 9C and 9D are views that illustrate the structure of the sub-tank to which a flow path cover is bonded, shown in FIGS. 7A, 7B and 7C.
Figure 9B:
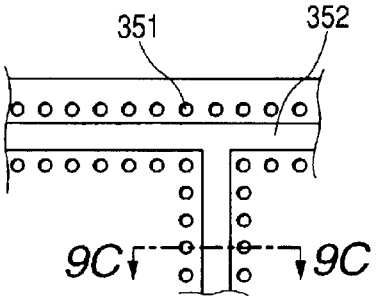
Figure 9C:
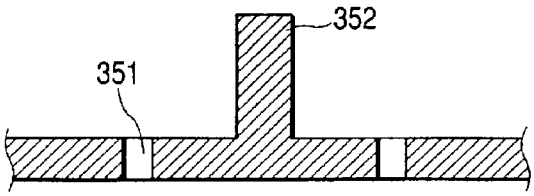
Figure 9D:
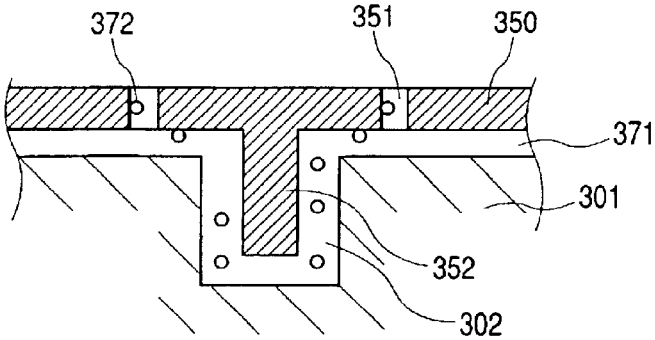

In contrast thereto, FIGS. 9A to 9D are views that illustrate the flow path cover that closes the liquid chamber of the sub-tank shown in FIG. 7A and others. FIG. 9A shows the flow path cover that closes the liquid chamber of the sub-tank shown in FIG. 7A and others. FIG. 9B is an enlargement of the 9B portion in FIG. 9A. FIG. 9C is a cross-sectional view taken along line 9C—9C in FIG. 9B. FIG. 9D shows the bonding condition immediately after the bonding of the flow path cover to the sub-tank by bonding agent until the bonding agent is cured.

As shown in FIG. 7A, the sub-tank 201*b* of the present embodiment is provided with a flow path cover-bonding portion 301 where the flow path cover 350 (see FIG. 9A) is bonded. The flow path cover-bonding portion 301 contains six liquid chambers 201$f_1$ to 201$f_6$ as shown in FIG. 7B. On the end face of the wall member that forms the liquid chambers 201$f_1$ to 201$f_6$, a groove 302 (indicated by slanted lines in FIG. 7B) is formed for coating bonding agent to bond the flow path cover 350. Each of the liquid chambers 201$f_1$ to 201$f_6$ corresponds to each of the nozzles 201$g_1$ to 201$g_6$ (see FIG. 6). Each of the liquid chambers 201$f_1$ to 201$f_6$ is arranged to expand radially from each of the nozzles 201$g_1$ to 201$g_6$ toward each of the sub-tank 201*b* in order to make the width formed by a plurality of nozzles 201$g_1$ to 201$g_6$ smaller than the width formed by a plurality of sub-tanks 201*b*. Each shape of the liquid chambers 201$f_1$ to 201$f_6$ is also made different from each other.

Further, everywhere in the groove 302, the bubble vent portion 303 that extends from the groove 302 into each of the liquid chambers 201$f_1$ to 201$f_6$ is provided. As shown in FIG. 7C, the bubble vent portion 303 forms a passage that connects the groove 302 and each liquid chamber 201*f*, with an inclined surface that makes the flow path narrower as it extends from the groove 302 toward the liquid chamber 201*f*.

Corresponding thereto, the flow path cover 350, which is bonded to the flow path-bonding portion 301 of the sub-tank portion 201*b* to close the liquid chambers 201$f_1$ to 201$f_6$, is provided with the extrusion 352 configured corresponding to the groove 302 of the flow path cover-bonding portion 301 as shown in FIG. 9A. The extrusion 352 fits into the groove 302 of the flow path cover-bonding portion 301, and functions to position the flow path cover 305 to the flow path cover-bonding portion 301. In addition thereto, it functions as a rib that prevents the flow path cover 350 itself from being warped. Further, the flow path cover 350 is provided with a plurality of air vent holes 351 that penetrate the surface of the flow path cover 350 to the backside thereof along both sides of the extrusion 352 (see FIGS. 9B and 9C). The air vent holes 351 are such as to release bubbles generated in bonding agent in the process of coating and curing the bonding agent to the air outside as shown in FIG. 9D.

Here, when the flow path cover-bonding portion 301 of the sub-tank 201*b* is observed from the flow path cover 350 side, that is, in the state shown in FIG. 7B, the groove 302 is structured by three components, the horizontally directed component (the component extending in the left and right directions in FIG. 7B), the vertically directed component (the component extending from the top to the bottom in FIG. 7B), and the diagonal component (the component intersecting at least either one of the vertically directed component and the horizontally directed component. In this manner, even if there is a "play" between the groove 302 and the extrusion 352, it is possible to control such play as much as possible by the groove 302 as a whole, which is formed by the three directional components. Therefore, these can be bonded in a better precision.

Also, of the three directional components of the groove 302, the portion where four components or more of them intersect (at X in FIG. 7B) has a larger coating area of bonding agent than that of the portion where three components or less of them intersect (at Y and Z in FIG. 7B). Particularly, therefore, when an automatic coating machine, such as X-Y coating machine, is used, the coating capability of bonding agent is enhanced at the intersecting portions. Bonding agent tends to generate bubbles particularly when it is coated at intersecting portions. However, as described above, the portion at X where the bonding agent coating area is made larger has more amount of bonding agent than other portions. As a result, even if bubbles are generated slightly more, the influence exerted by them is comparatively small, and the possibility is less that bubbles create voids, which may result in leakage between liquid chambers.

Next, the description will be made of the outline of the process for bonding the flow path cover 350 to the flow path cover-bonding portion 301 of the sub-tank 201*b* described above.

In this process, the sub-tank 201*b* is positioned and fixed, at first. Then, by use of a dispenser, bonding agent is continuously coated in the groove 302 of the flow path cover-bonding portion 301. At this juncture, a 20-gauge needle is used, for example, and the traveling speed thereof in the groove 302 is set at 6 mm/second. With this setting, bonding agent is filled in the groove 302 in good condition. Bubbles mixed in the bonding agent thus coated in the groove 302 are allowed to shift along the inclined surface of the bubble vent portion 303 provided everywhere in the groove 302 as shown in FIGS. 8A and 8B, thus being released to the air outside.

In continuation, the extrusion 352 of the flow path cover 350, which is positioned likewise, is fitted into the groove 302 of the flow path cover-bonding portion 301 of the sub-tank 201*b* to bond both of them. At this juncture, even if bubbles still remain in the bonding agent coated in the groove 302, bubbles shift toward the bubble vent portion 303, because the extrusion 352 presses bonding agent when being bonded. In this way, it becomes possible to prevent remaining bubbles in the groove 302 from running over the groove 302 to expand in the direction towards between liquid chambers, hence avoiding the generation of voids that may cause leakage between liquid chambers. For example, in the structure, for which no bubble vent portion 303 is provided, as shown in FIGS. 10A1 and 10A2, if bubbles are mixed in the bonding agent coated in the groove 302, such void as to connect liquid chambers inevitably when the flow path cover 350 is bonded as shown in FIGS. 10B1 and 10B2. In contrast, the structure of the present embodiment, for which the bubble vent portion 303 is provided, as shown in FIGS. 10C1 and 10C2 mixed bubbles shift toward the bubble vent portion 303 as the bonding agent is being pressed by the extrusion 352 at the time of bonding the flow path cover 350, and the mixed bubbles are released to the outside through the bubble vent portion 303. Consequently, the generation of voids, which run over between liquid chambers and result in leakage, can be prevented.

Lastly, to cure bonding agent completely, the sub-tank 201*b* and the flow path cover 350 thus bonded are put into an oven for curing. In this case, curing is made at 105° C. for five hours.

As has been described above, the bonding process of the flow path cover 350 to the flow path cover-bonding portion 301 is completed. In FIG. 9D and FIG. 10A2, a reference numeral 371 designates bonding agent, and 372, a mixed bubble.

VARIATIONAL EXAMPLES

First Variational Example

Figure 11:
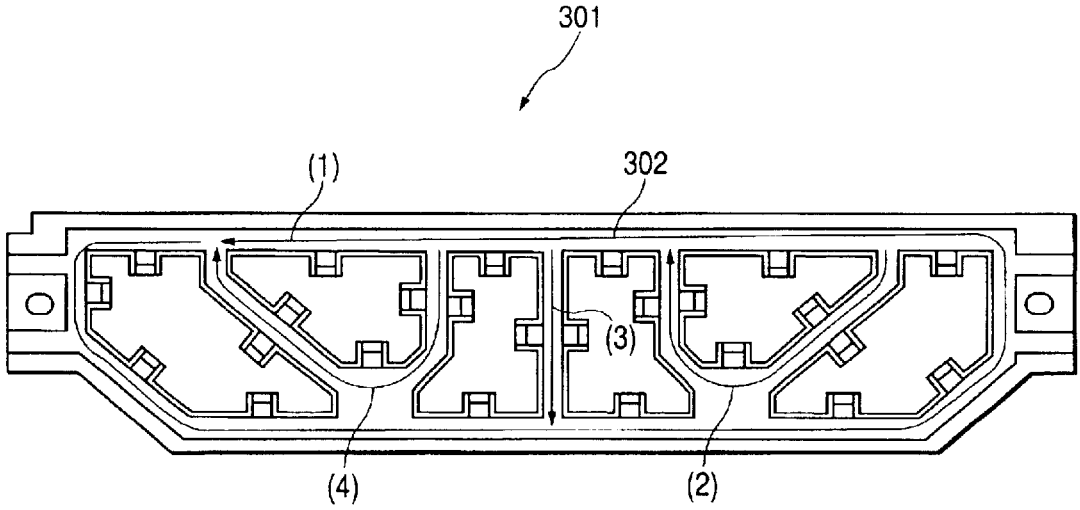
FIG. 11 is a view that shows the coating sequence of bonding agent in the groove portion.

Procedure of Coating Bonding Agent for the Groove of the Flow Path Cover-Bonding Portion and Others In order to prevent bubbles from being mixed in the bonding agent that has been coated, it is preferable to coat bonding agent in the groove 302 of the flow path cover-bonding portion 301 continuously like an application of one-stroke brushing. However, as in the flow path cover-bonding portion 301 of the present embodiment, it is impossible to apply bonding agent like adopting one-stroke brushing for all the parts of the groove 302 in some cases. In such a case, bonding agent is continuously coated in the groove 302 on the outer circumference of the flow path cover-bonding portion 301, at first, as shown in FIG. 11 (procedure (1)). After that, bonding agent is coated in the groove portion 302 provided for each end face of wall portions that partition liquid chambers, respectively, (procedures (2) to (4)). In this manner, coating is made first on the circumference of the flow path cover-bonding portion 301, thus making it possible to minimize the amount of bonding agent flowing into the groove 302 yet to be coated even when a bonding agent having a good flowability. In this way, mixed colors between liquid chambers can be prevented more reliably.

When coating bonding agent in the groove 302 the coating amount of bonding agent becomes larger in the corner part of the groove 302 than the straight part thereof if all the parts of the groove 302 is coated at the same coating speed. Therefore, the arrangement is made to increase the coating speed at the corner part, and decrease it at the straight part. In this way, the coating amount thereof can be stabilized, while preventing bubbles from being inclusively retained therein. For example, Siphel 614 manufactured by Shinetsu Kagaku Kogyo K.K. (viscosity: 20 ps±5 ps) is used as bonding agent, and with the adoption of a 22-gauge needle, it is arranged to set the coating speed at 6 mm/second in the straight part, and 12 mm/second in the corner part, while constantly keeping the coating amount of bonding agent discharged from the needle per unit time. In this manner, it becomes possible to bond the flow path cover 350 to the flow path cover-bonding portion 301 in good condition.

Also, as a method for changing the coating amounts of bonding agent at the corner part and the straight part of the groove 302 instead of the method described above, the traveling speed is kept constant for the needle that discharges bonding agent to the groove 302, while making the pressure, which is exerted on bonding agent to be discharged from the needle, lower at the corner part, and higher at the straight part. With this method, the same effect as described above is also obtainable.

Second Variational Example

The Shape of the Groove of the Flow Path Cover and the Shape of Extrusion

Figure 12A:
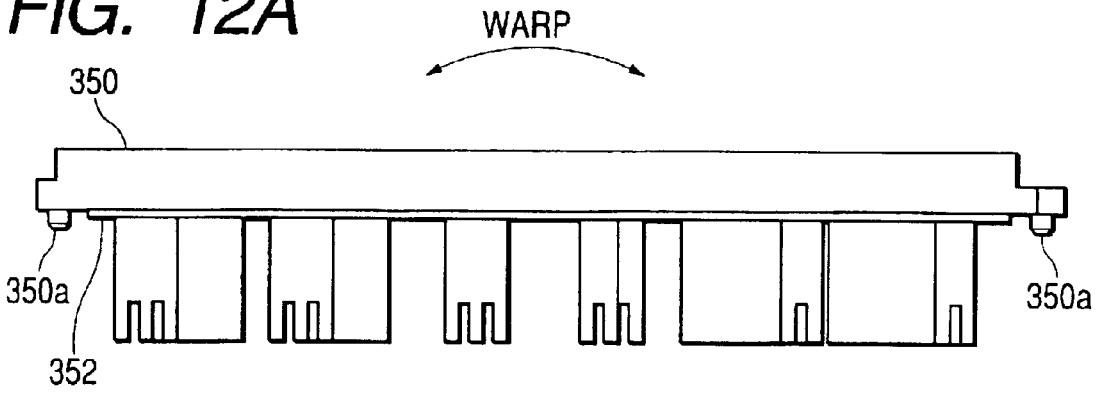
FIGS. 12A, 12B, and 12C are views that illustrate a flow path cover in accordance with the variational example.
Figure 12B:
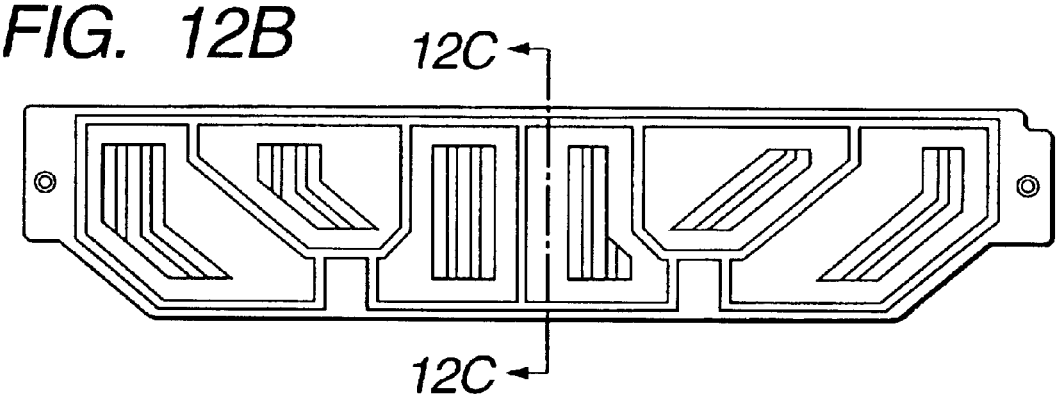
Figure 12C:
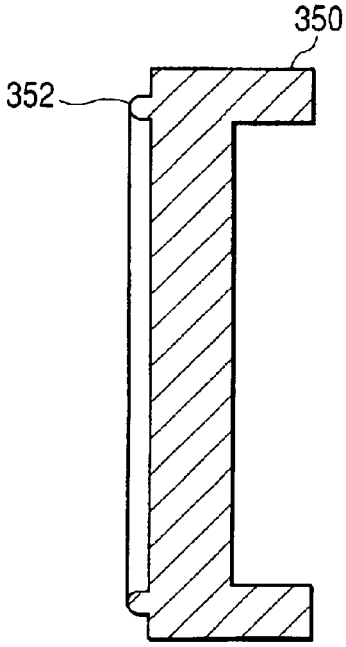
Figure 13A:
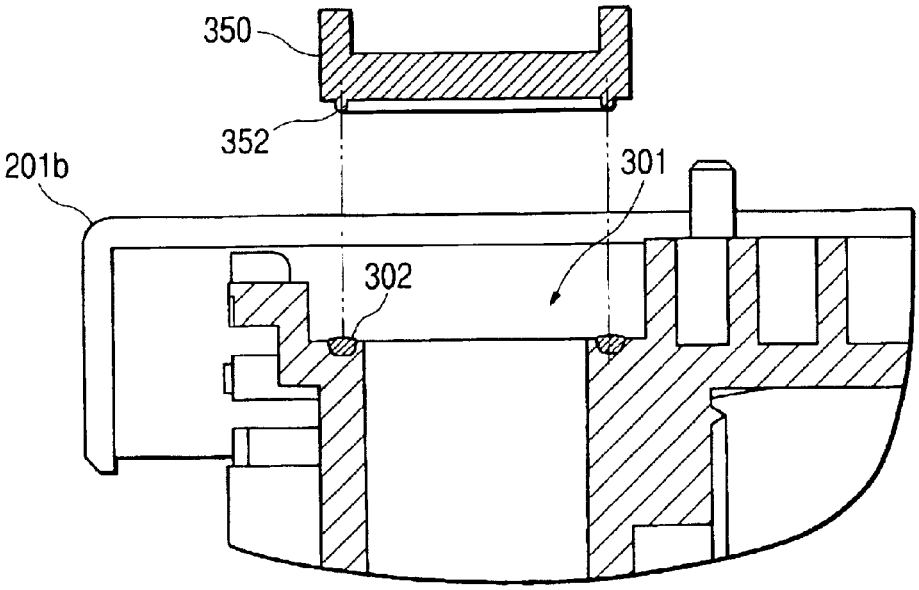
FIGS. 13A and 13B are views that illustrate the bonding condition between a flow path cover and a flow path cover bonding portion in accordance with the variational example.
Figure 13B:
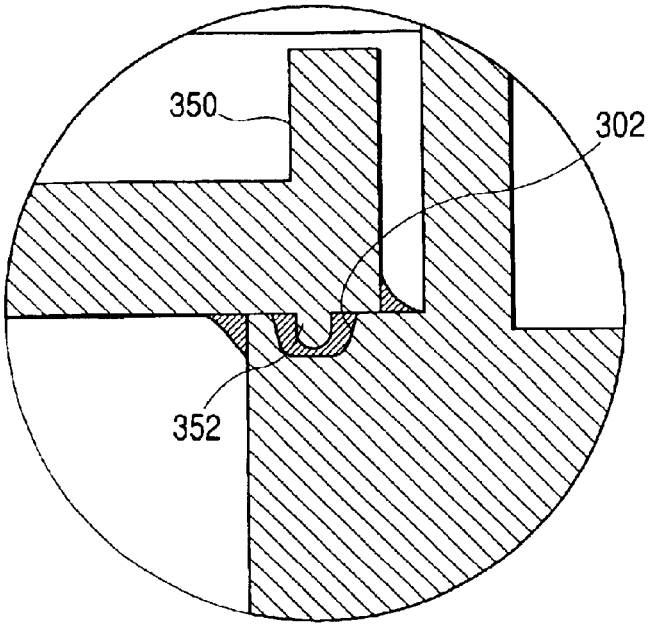

FIGS. 12A, 12B and 12C are views that illustrate a flow path cover in accordance with the present embodiment. FIG. 12A is a plan view of the flow path cover. FIG. 12B is a front view of the flow path cover. FIG. 12C is a cross-sectional view taken along line 12C—12C in FIG. 12B. Also, FIGS. 13A and 13B are views that illustrate the bonding condition between the flow path cover and the flow path cover-bonding portion in accordance with this variational example. FIG. 13A is a cross-sectional view that shows the state where the flow path cover and the flow path cover-bonding portion are position to each other. FIG. 13B is an enlarged sectional view that shows the bonding condition of the extrusion of the flow path cover and the groove of the flow path cover-bonding portion.

As shown in FIGS. 12A to 12C, the flow path cover 350 of this variational example is also provided with extrusion 352 in the same manner as the flow path cover shown in FIGS. 9A to 9D. However, for this variational example, the tip of the extrusion 352 is rounded as shown in FIG. 12C (R shape, for example). The extrusion 352 is all rounded likewise at the tip in the sectional portion thereof.

On the other hand, the groove 302 provided for the flow path cover-bonding portion 301 of the sub-tank of this variational example is configured to expand gradually from the bottom face toward the entrance as understandable from the representation of the cross-sectional view in FIG. 13B. Further, there is provided the curved line portion (R portion) that connects the bottom face and side face of the groove 302 smoothly. Also, for the groove 302, one and the same sectional shape is provided at either sectional portion.

Next, the description will be made of the bonding process between the flow path cover-bonding portion 301 and the flow path cover 350 in accordance with this variational example.

When both of them are bonded, the position of a dispenser is controlled on the basis of a given X-Y coordinate with respect to the groove 302 of the flow path cover-bonding portion 301 of the sub-tank at first, that is, the so-called X-Y coating machine or the like is used to enable bonding agent to flow in the groove 302 along the configuration thereof.

Here, since the groove 302 is configured to expand gradually toward the entrance as described above, it is made easier to coat bonding agent in the groove 302, and further, bonding agent enters deeply into the bottom of the groove 302 reliably, hence eliminating such drawback as to allow bonding agent to inclusively retain bubbles therein. Also, bubbles tend to be accumulated at the corner portion, but with the R portion provided for each ridgeline formed by the bottom face and side face of the groove 302, it is made possible to prevent bubbles from residing on the ridgeline thus formed. In this respect, it is preferable to provide the amount of bonding agent at this time so that bonding agent slightly swells from the entrance of the groove 302 as shown in FIG. 13A.

In continuation, the flow path cover 350 is bonded to the flow path cover-bonding portion 301 so as to enable the extrusion 352 of the flow path cover 350 to fit into the groove 302 of the flow path cover-bonding portion 301.

When the extrusion 352 of the flow path cover 350 is pressed into the groove 302 of the flow path cover-bonding portion 301, bonding agent in the groove 302 is forced to flow out of the groove 302 by an amount corresponding to the volume of the extrusion 352, which has been pressed into the groove 302. In a state where the extrusion 352 is pressed into the groove 302 complete, the flow path cover 350 and the flow path cover-bonding portion 301 abut against each other as shown in FIG. 13B. At this juncture, the bonding agent, which has flown out of the groove 302, seals the ridgeline-portion formed by the flow path cover 350 and the flow patch cover-bonding portion 301. Therefore, it becomes possible to prevent more effectively the adjacent liquid chambers from being communicated with each other. Also, since the tip of the extrusion 352 of the flow path cover 350 is in the form of R, the extrusion is in contact with bonding agent smoothly when pressed into it in the groove 302 and pushes it gradually as compared with the extrusion 352 shown in FIGS. 9A to 9C, the tip of which is angular. As a result, it is made possible to prevent the generation of bubbles in bonding agent or the inclusion thereof in it more reliably.

In this respect, when both of them are bonded, two extrusions 350*a*, which are arranged on the flow path cover 350 side, are pressed into the two elongated holes (not shown), which are arranged on the sub-tank side. In this way, it becomes easier to position them to each other, and to implement holding them until bonding agent is cured, thus preventing the flow path cover 350 from being dislocated from the sub-tank before bonding agent is cured.

Also, there is a tendency due to the configuration of the flow path cover 350 itself that it is bent inwardly with reference to each of the positioning bosses provided on both sides as shown in FIG. 12A. Therefore, the height of the extrusion 352 that serves as bonding boss for the flow path cover 350 needs to be made larger than the amount to which the flow path cover 350 is bent as a whole. It is desirable to satisfy the following relations between the height of the extrusion 352 and the amount of bending of the flow path cover 350 as a whole:

The height of extrusion>the amount of bending of flow path cover as a whole.

For this example, the amount of bending of flow path cover 350 as a whole is within a range of 0.2 to 0.3 mm specifically. Therefore, the height of the extrusion 352 of flow path cover 350 is set at 0.4 mm. In this way, even if the extrusions 350*a* that dually serves as a positioning device in two locations of both sides abut against the flow path cover so that the central portion of the flow path cover 350 is caused to float up by the amount of bending thereof as a whole, the tip of the extrusion 352, which is located on the central portion of the flow path cover 350, is placed into the groove 302. Thus, it becomes possible to prevent leakage or the like from occurring between liquid chambers themselves due to defective bonding or the like.

Third Variational Example

Curing of Bonding Agent

Figure 14:
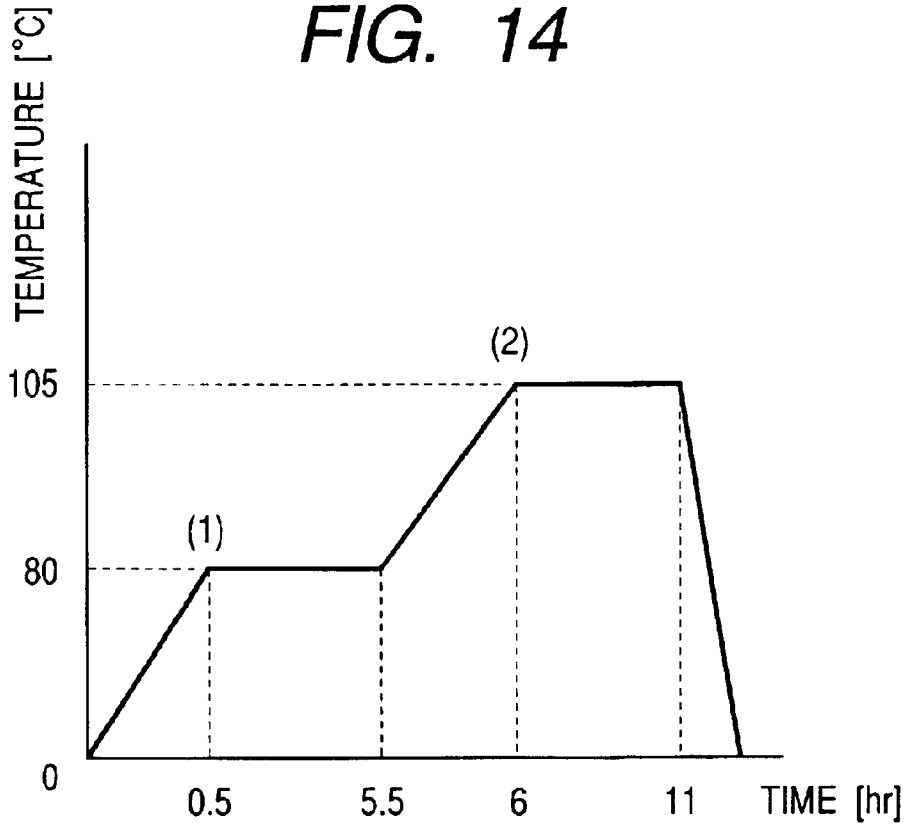
FIG. 14 is a graph that shows the temperature changes when bonding agent is given hardening cure.

FIG. 14 is a graph that shows the temperature changes at the time of hardening cure of bonding agent used for this variational example.

For this variational example, a pre-curing (at a temperature of 80° C.) is effectuated before a regular curing (at a temperature of 105° C.). Here, the term "pre-curing" means hardening bonding agent at a comparatively low temperature (less than 100° C., for example) preceding the regular curing whereby to harden bonding agent at a comparatively high temperature (100° C. or more, for example). The pre-curing is conducted in order to suppress vapors from members to be bonded to be mixed in bonding agent.

Figure 15:
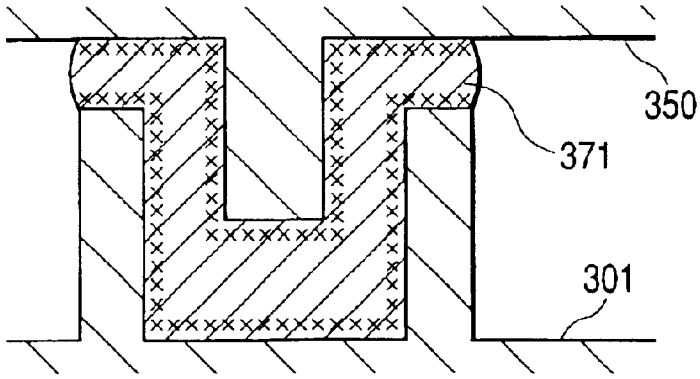
FIG. 15 is a view that shows the condition of bonding agent for which a pre-curing is conducted.
Figure 16:
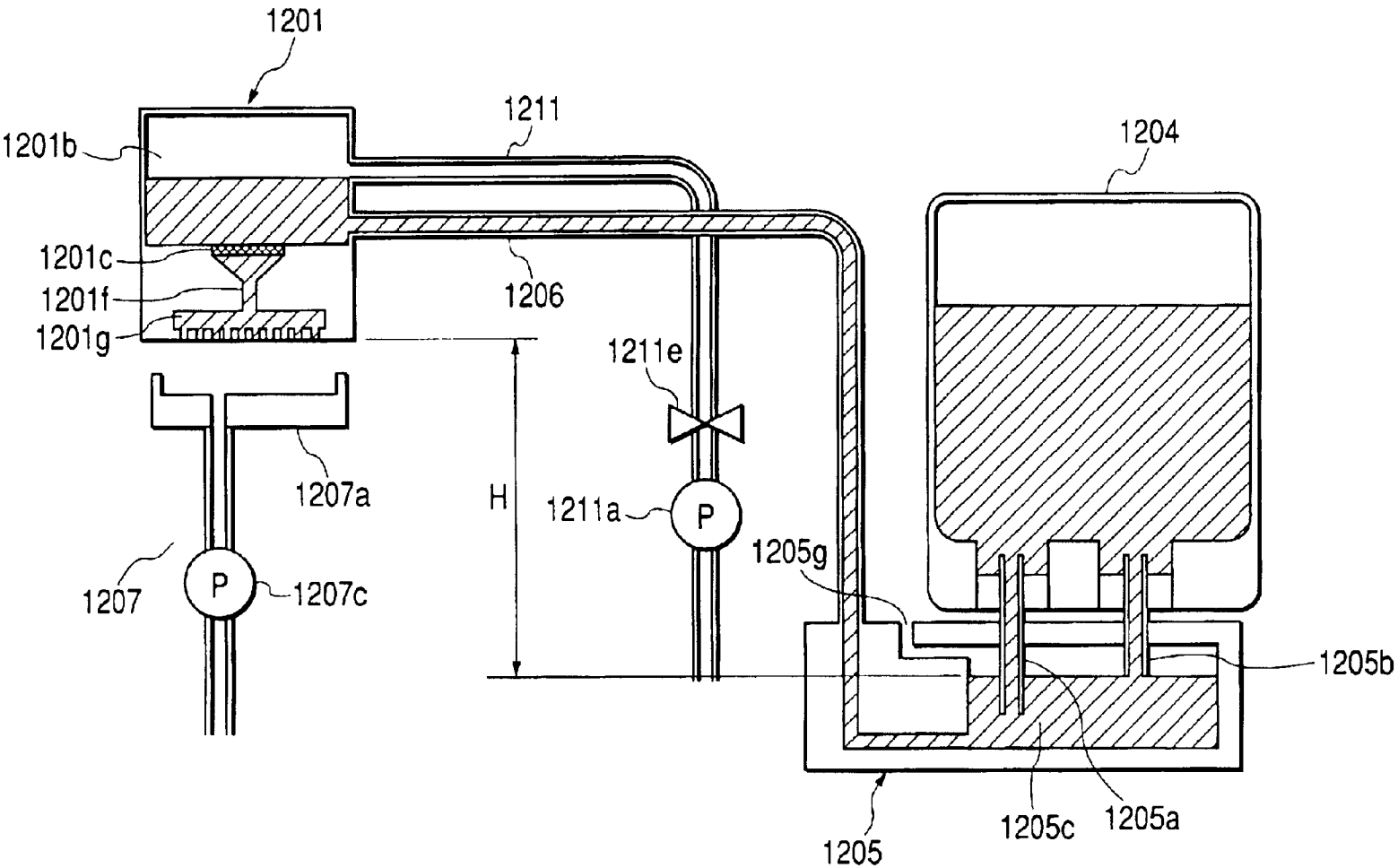
FIG. 16 is a view that shows the ink supply system of the conventional ink jet recording apparatus of tube supply type.
Figure 17A:
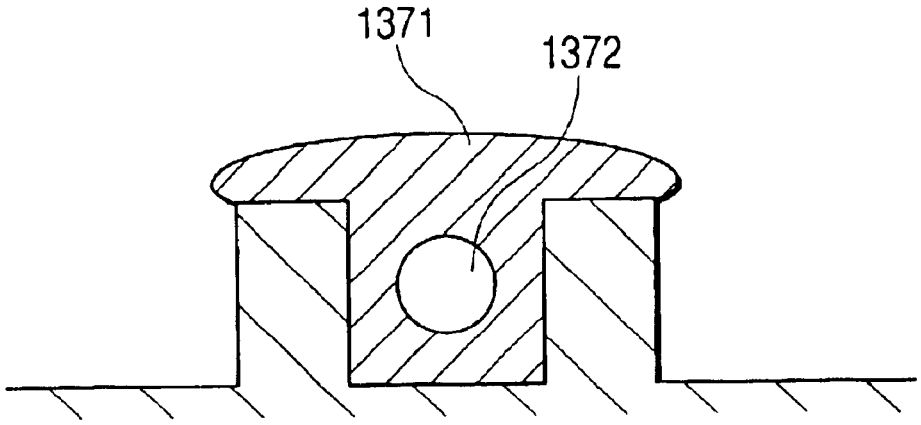
FIGS. 17A and 17B are views that illustrate the state where bubble mixed in bonding agent forms the hollow that connects liquid chambers.
Figure 17B:
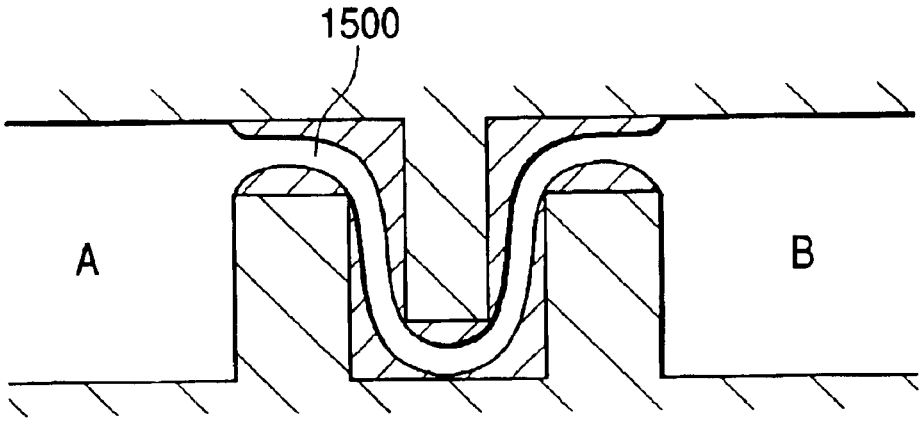
Figure 18A:
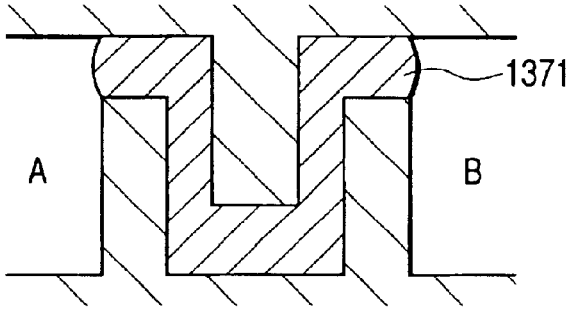
FIGS. 18A, 18B, and 18C are views that illustrate the state where bubble mixed in bonding agent forms the hollow that connects liquid chambers.
Figure 18B:
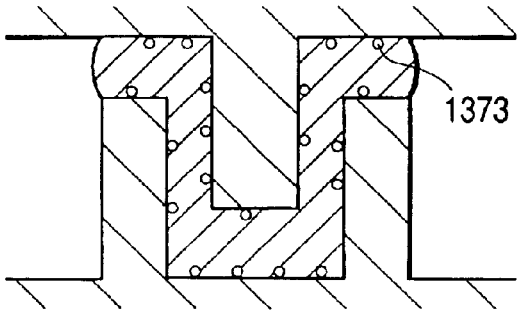
Figure 18C:
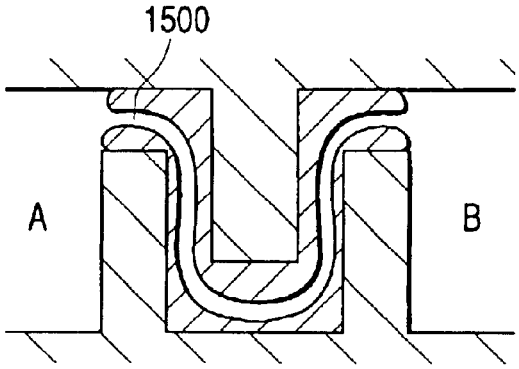

In accordance with this variational example, during the period of time (1) of heating by pre-curing (at a temperature of 80° C.), bonding agent is heated in the sub-tank 201*b* and the flow path cover 350, and hardening is advanced in each of the portions to be in contact with each other. In continuation, through the period of time (2) of the regular curing (at a time of 105° C.), bonding agent is completely hardened. At this time, the portions of bonding agent, which are in contact with the sub-tank 201*b* and the flow path cover 350, are half cured (see those indicated by x marks in FIG. 15) through the pre-curing process. Therefore, even if vapors are generated from the sub-tank 201*b* and the flow path cover 350 by the application of high temperature in the regular curing process, such vapors cannot pass the half-curing bonding agent. In this way, it is made possible to suppress the mixture of vapors in bonding agent.

In this respect, the ink jet recording apparatus, which demonstrates its effect by mounting the aforesaid ink jet recording head thereon, is not necessarily limited to that of serial type as shown in FIG. 1. It is needless to mention that an ink jet recording apparatus of the so-called line type can also demonstrate the same effect.

As described above, in accordance with the present invention, it is arranged that when the extrusion is fitted into the groove after coating boning agent in the groove for bonging the covering member to the liquid chamber, the gas remaining in bonding agent is released to the outside of the groove. Therefore, it is made possible to prevent the voids, which allow the adjacent liquid chambers to be communicated, from being formed by remaining gas in bonding agent, thus closing airtightly each of the liquid chambers reliably, and to prevent leakage or the like from being generated between the liquid chambers.

What is claimed is:

1. An ink jet recording head comprising:

an ink tank;

a nozzle for discharging ink;

a liquid chamber for retaining a specific amount of ink supplied from said ink tank through a filter, while supplying ink to said nozzle; and a covering member to be bonded to said liquid chamber, wherein, on the circumference of said liquid chamber, a groove is formed to enable bonding agent to be coated therein, and on the circumference of said covering member, an extrusion is formed to be fitted into said groove, and gas releasing means is provided for releasing gas remaining in said bonding agent to the outside of said groove when said covering member is bonded to said liquid chamber by fitting said extrusion into said groove after said bonding agent is coated in said groove.

2. An ink jet recording head according to claim 1, wherein said gas releasing means is provided on said covering member side.

3. An ink jet recording head according to claim 2, wherein said gas releasing means is a hole formed to penetrate the surface of said covering member to the backside thereof along said extrusion of said covering member.

4. An ink jet recording head according to claim 1, wherein said gas releasing means is provided on said liquid chamber side.

5. An ink jet recording head according to claim 4, wherein said gas releasing means is a passage communicating the space in said groove with the space in said liquid chamber.

6. An ink jet recording head according to claim 1, wherein plural sets, each comprising an ink tank, a nozzle, and a liquid chamber, are individually provided.

7. An ink jet recording head according to claim 6, wherein said respective liquid chambers are configured to radially expand from said plural nozzles toward said ink tanks, respectively, to make the width formed by said plural nozzles smaller than the width formed by said plural ink tanks.

8. An ink jet recording head according to claim 1, wherein said groove has a width expanding gradually from the bottom face to the entrance thereof, and a sectional shape formed with a smoothly curved line connecting the bottom face and the side face.

9. An ink jet recording head according to claim 1, wherein said extrusion has a sectional shape having a rounded tip portion.

10. An ink jet recording head according to claim 1, wherein relations between the height of said extrusion of said covering member and the amount of bending of said covering member as a whole are:

the height of extrusion>the amount of bending of covering member as a whole.

11. An ink jet recording head according to claim 1, wherein the shape of said groove observed from the side to which said covering member is bonded is formed by a vertical component, a horizontal component, and a diagonal component intersecting at least at one of said vertical component and said horizontal component.

12. An ink jet recording head according to claim 11, wherein the bonding agent coating area of a portion having any four or more intersecting components is larger than the bonding agent coating area of a portion having any three or fewer intersecting components, among said vertical, horizontal, and diagonal components of said groove.

13. An ink jet recording apparatus comprising:

an ink jet recording head according to any one of claims 1 to 12.

14. A method for manufacturing an ink jet recording head provided with an ink tank, a nozzle for discharging ink, a liquid chamber for retaining a specific amount of ink supplied from said ink tank through a filter, and a covering member to be bonded to said liquid chamber, a groove being formed on the circumference of said liquid chamber for bonding agent to be coated in the groove, and an extrusion being formed on the circumference of said covering member to be fitted into said groove, said method comprising the steps of:

coating the bonding agent in said groove;

bonding said covering member to said liquid chamber by fitting said extrusion into said groove; and releasing gas remaining in the bonding agent to the outside of said groove.

15. A method for manufacturing an ink jet recording head according to claim 14, wherein a hole is provided for said covering member penetrating the surface of said covering member to the backside thereof along said extrusion, and said step of releasing gas remaining in the bonding agent to the outside of said groove comprises the step of releasing said gas to the outside of the groove through said hole.

16. A method for manufacturing an ink jet recording head according to claim 14, wherein a passage is provided for said liquid chamber communicating the space in said groove and the space in said liquid chamber, and said step of releasing gas remaining in said bonding agent to the outside of said groove comprises the step of releasing said gas to the outside of the groove through said passage.

17. A method for manufacturing an ink jet recording head according to claim 14, wherein said step of coating the bonding agent in said groove is to continuously coat the bonding agent during the period from the start to the end of coating the bonding agent.

18. A method for manufacturing an ink jet recording head according to claim 17, wherein said coating step is performed with a needle for discharging the bonding agent, and the traveling speed of the needle with respect to said groove is changed when coating the bonding agent on a straight portion of said groove and at a corner portion of said grove, while keeping constant the coating amount of the bonding agent discharged from the needle per unit time.

19. A method for manufacturing an ink jet recording head according to claim 17, wherein the discharge pressure of the bonding agent from a needle for discharging the bonding agent is changed when coating the bonding agent on a straight portion of said groove and at a corner portion of said grove, while keeping the traveling speed of the needle with respect to said groove constant.

20. A method for manufacturing an ink jet recording head according to claim 14, further comprising the step of:

curing the bonding agent to be hardened after the step of releasing gas remaining in the bonding agent to the outside of said groove.

21. A method for manufacturing an ink jet recording head according to claim 20, wherein said curing step comprises a pre-curing step of hardening the bonding agent at a comparatively low temperature, and a regular curing step of hardening the bonding agent at a comparatively high temperature.

* * * * *